US011536023B2

(12) United States Patent
Loyd et al.

(10) Patent No.: US 11,536,023 B2
(45) Date of Patent: Dec. 27, 2022

(54) PANEL INSTALLATION SYSTEM AND METHOD

(71) Applicant: Stephen N. Loyd Irrevocable Family Trust, Dallas, TX (US)

(72) Inventors: Stephen N. Loyd, Garland, TX (US); William Ty May, Plano, TX (US)

(73) Assignee: Stephen N. Loyd Irrevocable Family Trust, Dallas, TX (US)

( * ) Notice: Subject to any disclaimer, the term of this patent is extended or adjusted under 35 U.S.C. 154(b) by 0 days.

(21) Appl. No.: 17/079,130

(22) Filed: Oct. 23, 2020

(65) Prior Publication Data

US 2022/0127848 A1 Apr. 28, 2022

(51) Int. Cl.
*E04B 2/88* (2006.01)
*E04F 13/08* (2006.01)

(52) U.S. Cl.
CPC ..... *E04B 2/88* (2013.01); *E04F 13/0826* (2013.01)

(58) Field of Classification Search
CPC ..... E04F 13/0826; E04F 13/0803; E04F 13/0808; E04F 13/083; E04F 13/0812; E04F 13/0816; E04F 13/0891; E04F 13/0889; E04F 13/0894; E04F 13/0898; E04B 2/88
See application file for complete search history.

(56) References Cited

U.S. PATENT DOCUMENTS 2,245,785 A 6/1941 Jentzer et al.
3,343,322 A 9/1967 Mayfield
3,640,043 A 2/1972 Querfeld et al.
3,786,605 A 1/1974 Winfrey
3,831,506 A 8/1974 Landheer
4,070,835 A 1/1978 Reverend et al.
4,344,267 A * 8/1982 Sukolics ..... E04B 1/617 52/510
4,483,122 A 11/1984 Crandell
4,506,482 A 3/1985 Pracht et al.
4,625,481 A 12/1986 Crandell
4,833,858 A * 5/1989 Hutchison ..... E04B 1/6166 52/475.1

(Continued)

FOREIGN PATENT DOCUMENTS

DE 102018126983 B4 * 8/2020 ..... E04F 13/0821

*Primary Examiner* — Theodore V Adamos
(74) *Attorney, Agent, or Firm* — Slater Matsil, LLP

(57) ABSTRACT

In certain embodiments, a panel installation method includes attaching first and second support anchors to a substrate, with the second support anchor spaced apart from the first support anchor. Each support anchor is elongated and includes a base for attaching to the substrate and respective projections extending outwardly from the bases. A tab extends upwardly from the first support anchor's projection, and a prong extends from the second support anchor's base. The method includes mounting a panel having first and second ends to the substrate via the first and second support anchors, including coupling the first end to the first support anchor, coupling an interlocking bracket to the second end, and coupling the second end to the second support anchor by engaging the interlocking bracket with the prong. The method includes positioning a stabilizing insert in a gap between the interlocking bracket and the projection of the second support anchor.

21 Claims, 11 Drawing Sheets

(56) References Cited

U.S. PATENT DOCUMENTS 5,065,557 A 11/1991 Laplante et al.
5,155,958 A 10/1992 Huff
5,263,292 A * 11/1993 Holland ..... E04B 2/92 52/235
5,265,396 A 11/1993 Amimoto
5,301,484 A 4/1994 Jansson
5,313,760 A 5/1994 Tojo
5,373,672 A 12/1994 Schulz
5,473,851 A 12/1995 Northrup, Jr.
6,098,364 A 8/2000 Liu
6,170,214 B1 1/2001 Treister et al.
6,202,377 B1 3/2001 Krieger
6,289,644 B1 9/2001 Gerhaher
6,289,646 B1 9/2001 Watanabe
6,792,727 B2 9/2004 Krieger
7,562,504 B2 * 7/2009 Herbst ..... E04F 13/0805 52/235
7,752,818 B1 * 7/2010 Roegge ..... E04F 13/12 52/235
8,051,623 B2 11/2011 Loyd
8,336,264 B2 12/2012 Sato et al.
8,341,901 B2 1/2013 Loyd
8,839,582 B2 9/2014 Aboukhalil
8,925,271 B1 * 1/2015 Bilge ..... E04F 13/12 52/506.05
8,950,131 B2 2/2015 Loyd
9,080,331 B2 7/2015 Aboukhalil
9,359,770 B1 * 6/2016 Bilge ..... E04F 13/072
9,506,252 B2 11/2016 Molteni
9,631,373 B2 4/2017 Loyd
10,526,791 B2 1/2020 Loyd
10,697,183 B1 * 6/2020 Ferguson ..... E04F 13/26
2002/0005024 A1 1/2002 Hsueh
2002/0152693 A1 10/2002 Krogstad
2003/0150179 A1 8/2003 Moreno
2004/0134143 A1 * 7/2004 Boyer ..... E04F 13/0878 52/235
2005/0246983 A1 * 11/2005 Loyd ..... E04F 13/0826 52/235
2007/0022682 A1 2/2007 Morgenegg et al.
2008/0010922 A1 1/2008 Wagner
2008/0216444 A1 * 9/2008 Loyd ..... E04F 13/0826 52/742.16
2009/0031652 A1 2/2009 Catalan
2009/0145071 A1 * 6/2009 Radford ..... E04F 19/061 52/506.08
2012/0117901 A1 5/2012 Loyd
2012/0137609 A1 6/2012 Loyd
2012/0317909 A1 12/2012 MacKenzie
2014/0202113 A1 * 7/2014 Bilge ..... E04F 13/0866 52/590.1
2017/0335564 A1 * 11/2017 Loyd ..... E04F 13/0846
2018/0155933 A1 * 6/2018 Simonsen ..... E04F 13/0821
2019/0177982 A1 * 6/2019 Knapp ..... E04F 13/0828
2020/0141127 A1 5/2020 Loyd

* cited by examiner

PANEL INSTALLATION SYSTEM AND METHOD

TECHNICAL FIELD

This disclosure relates generally to construction, and more particularly to a panel installation system and method.

BACKGROUND

It may be desirable to attach one or more panels to a substrate. For example, structures, such as buildings and homes, include one or more walls. These walls may be interior and/or exterior walls. In certain instances, it may be desirable to install a covering on the wall. The covering may serve a variety of purposes. For example, the covering may enhance or otherwise alter the appearance of the wall. As another example, the covering may protect the wall from damage, such as weather-related damage. As another example, the covering may provide a layer of insulation for the structure. As another example, the covering may provide a combination of these and other advantages. Various types of objects, such as those formed from concrete, ceramic, stone, glass, fiberglass, photovoltaic panels, carbon fiber, steel, aluminum, or other suitable materials, may be used to provide the covering. In many instances, difficulties may be encountered in supporting and installing the desired wall covering. These difficulties may result in problems such as ill-fitting portions and an inefficient, time-consuming installation process that yields a less than desirable result.

SUMMARY

In certain embodiments, a curtain wall system includes first and second support anchors, a curtain wall member, an interlocking bracket, and a locking clip. The first support anchor is elongated and includes a base for attaching the first support anchor to a wall. A projection extends outwardly from the base of the first support anchor, and a tab extends upwardly from the projection of the first support anchor. The second support anchor is elongated and includes a base for attaching the second support anchor to the wall spaced apart from the first support anchor. A projection extends outwardly from the base of the second support anchor, and a prong extends from the base of the second support anchor. The curtain wall member is adapted to be mounted to the wall via the first support anchor and the second support anchor such that a first end of the curtain wall member is coupled to the first support anchor and a second end of the curtain wall member is coupled to the second support anchor. The interlocking bracket is configured to couple to the second end of the curtain wall member and to engage with the prong of the second support anchor for coupling the second end of the curtain wall member to the second support anchor. The locking clip is configured to be positioned in a gap between the interlocking bracket and the projection of the second support anchor.

In certain embodiments, a panel installation method includes attaching a first support anchor to a substrate. The first support anchor is elongated and includes a base for attaching the first support anchor to the substrate. A projection extends outwardly from the base of the first support anchor, and a tab extends upwardly from the projection of the first support anchor. The method further includes attaching a second support anchor to the substrate spaced apart from the first support anchor. The second support anchor is elongated and includes a base for attaching the second support anchor to the substrate. A projection extends outwardly from the base of the second support anchor, and a prong extends from the base of the second support anchor. The method further includes mounting a panel to the substrate via the first support anchor and the second support anchor. Mounting the panel includes coupling a first end of the panel to the first support anchor, coupling an interlocking bracket to a second end of the panel, and coupling the second end of the panel to the second support anchor by engaging the interlocking bracket with the prong of the second support anchor. The method further includes positioning a stabilizing insert in a gap between the interlocking bracket and the projection of the second support anchor.

In certain embodiments, a panel installation system includes first and second support anchors, a first panel, a first interlocking bracket, and a first stabilizing insert. The first support anchor is elongated and includes a base for attaching the first support anchor to a substrate. A projection extends outwardly from the base of the first support anchor, and a tab extends upwardly from the projection of the first support anchor. The second support anchor is elongated and includes a base for attaching the second support anchor to the substrate spaced apart from the first support anchor. A projection extends outwardly from the base of the second support anchor, and a prong extends from the base of the second support anchor. The first panel is adapted to be mounted to the substrate via the first support anchor and the second support anchor such that a first end of the first panel is coupled to the first support anchor and a second end of the first panel is coupled to the second support anchor. The first interlocking bracket is configured to couple to the second end of the first panel and to engage with the prong of the second support anchor for coupling the second end of the first panel to the second support anchor. The first stabilizing insert is configured to be positioned in a gap between the first interlocking bracket and the projection of the second support anchor.

Particular embodiments of this disclosure may provide one or more technical advantages. For example, certain embodiments provide an efficient system and installation method for installing panels to create a panel field. Certain embodiments allow panels of a panel field to be removed (and replaced, if appropriate) individually and without damaging the panel, reducing or eliminating the need to remove (and replace, if appropriate) numerous panels to remove/replace an isolated panel, which may improve efficiency in producing a desired panel field, reduce materials costs (e.g., the cost of multiple replacement panels), and reduce the cost of labor (e.g., for the time spent removing, and possibly replacing, multiple panels). Furthermore, because in certain embodiments panels may be removed without breaking or otherwise damaging the panels, replacing a panel may involve reinstalling the same panel that was removed, which over time may reduce costs associated with purchasing new replacement panels and may reduce or eliminate delays associated with obtaining new replacement panels.

Certain embodiments allow large and/or heavy panels to be installed. For example, due to the manner of engagement of an interlocking bracket with a prong of a support anchor and/or the use of a locking clip to further secure a panel that is mounted to support anchors attached to a substrate (e.g., a wall), mounted panels may be more securely mounted in position on support anchors attached to the substrate. Additionally or alternatively, one or more components used mount panels to a substrate (e.g., a wall) may be made of a variety of materials including high-grade stainless steel, which may increase a reliability of a coupling of panels to support anchors mounted to the substrate. For example, one or more of the support anchors, the interlocking bracket, or the locking clip may be made of such high-grade stainless steel. In certain embodiments, the panel installation system of this disclosure can support panels of exceeding nine square feet, three inches thick and weighing thousands of pounds.

Although described primarily in the context of a curtain wall system (with the panels being curtain wall members and the substrate being a wall), the system and techniques described herein may be used in any of a variety of applications, and with the panels having any suitable size, shape, and weight. That is, the system and techniques described herein can be scaled up to accommodate extremely large and/or heavy panels (e.g., structural framing size or more) or scaled down to include small and/or light panels. As just one particular example, a very small version might be used to secure a thin panel (e.g., 4 mm thick) or glass panels for mounting on a system that can be made for very corrosive environments. As another particular example, a large version of the system might be used to secure panels that form a sea wall or that form a blast fence on a military aircraft launch area. The size and materials of the panels and the components of the system may be customized to accommodate the applicable installation.

For example, aside from curtain walls generally, the system and techniques described herein may be used for any type of cover panel that may benefit from a process for removal for access or replacement, particularly if in a field of numerous panels. Some examples may include: precast concrete, photovoltaic panels, dimensional stone, screening, reflectors, radio communication equipment mounting, antenna covers such as cellular or microwave antenna covers, jet wash deflection assemblies, blast mitigation panels, marine docks and buildings, sea walls, interior trim panels, solar panel attachment, light panel attachment, and others.

As one example, the panels may include lighting or one or more displays. As a particular example, the panels may include area lighting, accent lighting, and/or displays. In the case of displays, a panel that includes a display could be part of a field of panels that collectively make up one large display.

The components of the system can be created from any structurally sound material such as aluminum, steel, stainless steel, carbon fiber, structural plastics and foams, fiberglass, magnesium, and titanium, as just a few examples. Some projects might require the system to be non-conductive both thermally and electrically, so materials that meet those needs may be selected. Another project might require extreme resistance to corrosion, such as a removable panel system on an aircraft carrier, so materials that meet those needs may be selected.

Certain embodiments of this disclosure may provide some, all, or none of these advantages. Certain embodiments may provide one or more other technical advantages, one or more of which may be readily apparent to those skilled in the art from the figures, descriptions, and claims.

BRIEF DESCRIPTION OF THE DRAWINGS

To provide a more complete understanding of embodiments of this disclosure and the features and advantages thereof, reference is made to the following description taken in conjunction with the accompanying drawings, in which.

DETAILED DESCRIPTION OF ILLUSTRATIVE EMBODIMENTS

Figure 1:
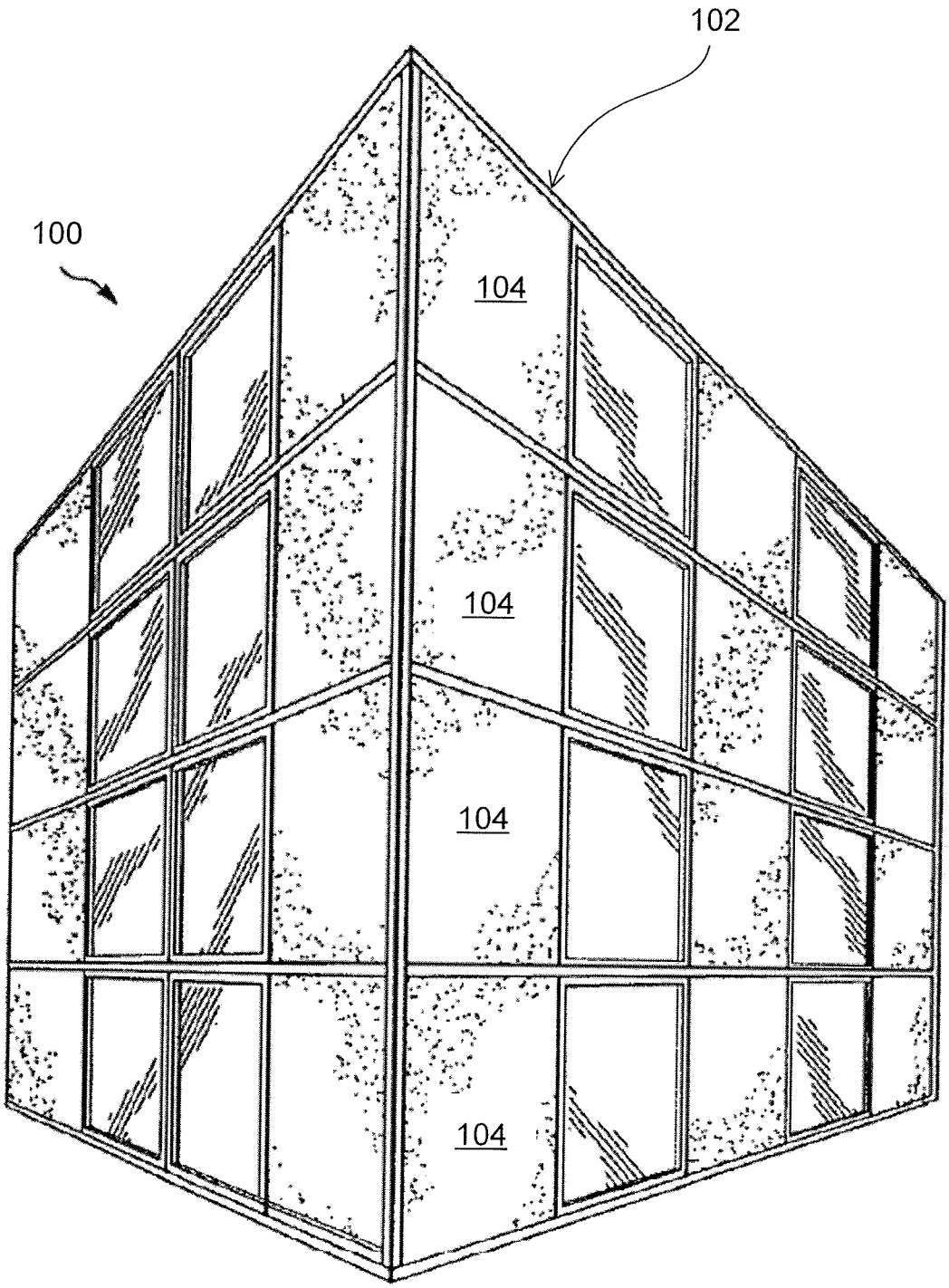
FIG. 1 illustrates an environmental view of an example of a structure with curtain walls installed in accordance with certain embodiments of this disclosure.

FIG. 1 illustrates an environmental view of an example of a structure 100 with panel field 102 of panels 104 installed in accordance with certain embodiments of this disclosure. For example, structure 100 may be a building, panel fields 102 may be curtain walls, and panels 104 may be curtain wall members. Panels 104 may include any suitable type of covering, including, for example, bricks, tiles, blocks, or any other suitable objects that may be mounted to a substrate. Furthermore, panels 104 may be made of any suitable type of material or combination of materials, including, for example, concrete, ceramic, stone, glass, fiberglass, photovoltaic panels, carbon fiber, steel, aluminum, wood, composite graphite, or any other suitable material or combination of materials. Particular examples of panels 104 are dimensional stone panels or precast concrete panels. Additionally, the types and materials of panels 104 may be mixed within a particular installation, if desired. Panels 104 may have any suitable dimensions. Furthermore, the dimensions of panels 104 may vary, as desired.

Panels 104 may be installed using a panel installation system and associated installation techniques described in this disclosure, and FIG. 1 is included to provide just one example of an environment in which the panel installation system and associated installation techniques described in this disclosure may be used.

Figure 2:
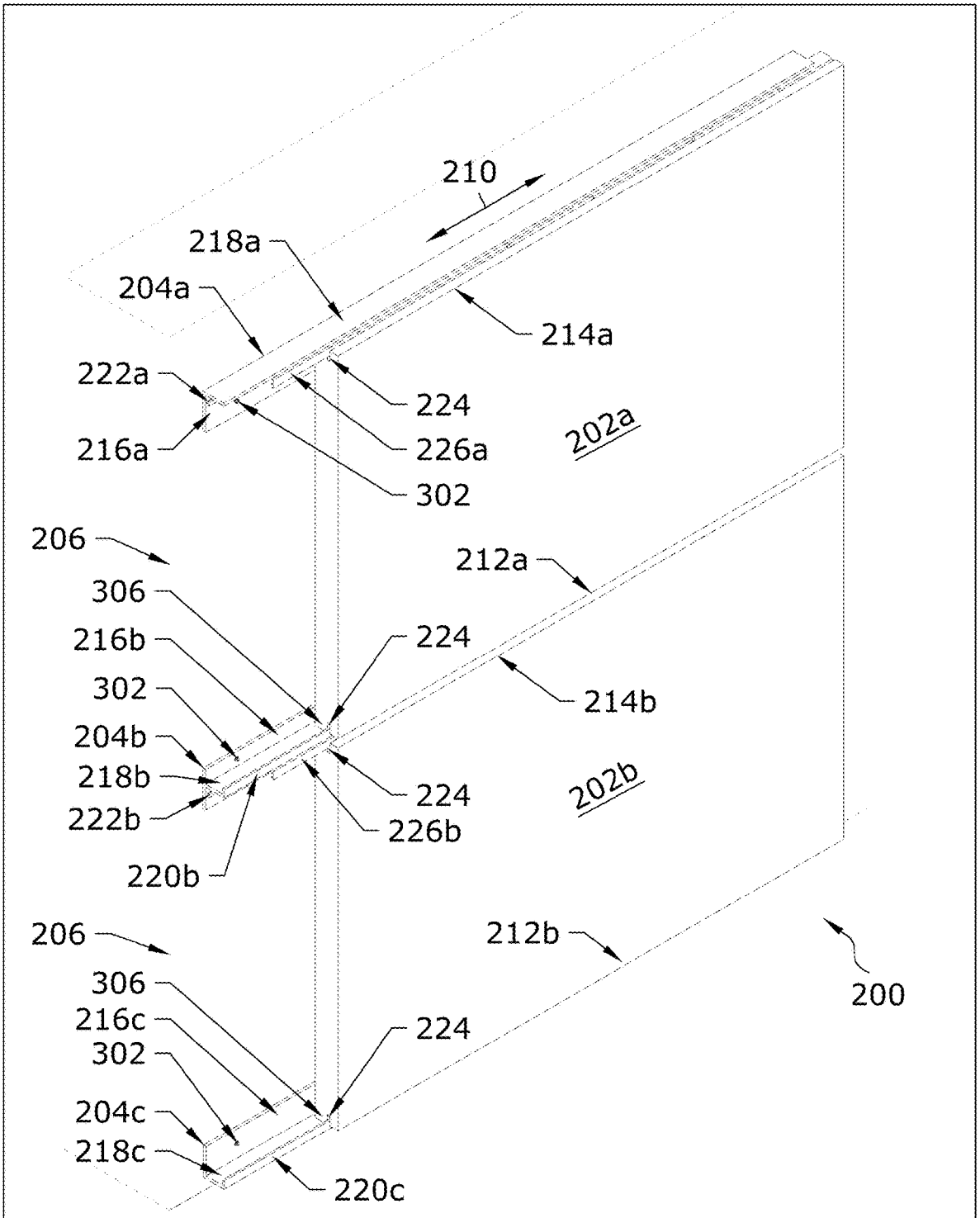
FIG. 2 illustrates a portion of an example curtain wall system, according to certain embodiments of this disclosure.

FIG. 2 illustrates a portion of an example panel installation system 200, according to certain embodiments of this disclosure. For example, panel installation system 200 illustrates an example of a system for installing a portion of panel field 102 of structure 100 in FIG. 1.

Panel installation system 200 includes, for purposes of illustrating the example, two panels 202 (in particular, panel 202*a* and panel 202*b*), which may be analogous to panels 104 of FIG. 1. Thus, the above-described features of panels 104 are incorporated by reference into the description of panels 202. Panels 202 may have any suitable dimensions, according to particular implementations. Additionally, panels 202 may have any suitable shape, including flat or curved. As with FIG. 1, in one example, panel installation system 200 could be a curtain wall system and panels 104 could be curtain wall members. Panels 202 may be made of any suitable material. Panels 202 may be solid or may be open (e.g., grating, louvered panels, or metal foam panels).

In some instances, this disclosure adopts a naming/reference-numeral convention in which multiple elements are assigned a same number with a letter designating a particular instance of that element. In the above paragraph, for example, panels are assigned the reference numeral 202, and particular panels 202 are assigned the reference numeral 202*a* and 202*b*. Reference may be made to the element generally using only the number, or reference may be made to a particular instance using the number/letter combination. For example, panels may be referred to generally as panel 202 or panels 202, and a particular panel of the illustrated panels may be referred to as panel 202*a* or panel 202*b*.

Panel installation system 200 includes multiple support anchors 204 for mounting panels 202 to a wall. In the example illustrated in FIG. 2, panel installation system 200 includes support anchor 204*a* (which may be a top support anchor), support anchor 204*b* (which may be an intermediate support anchor), and support anchor 204*c* (which may be a bottom support anchor).

Support anchors 204 are attached to substrate 206. In certain embodiments, substrate 206 is a wall of a structure; however, this disclosure contemplates substrate 206 being any suitable type of substrate, including, for example, a ceiling, soffit, or floor. Additionally, substrate 206 may be vertical, horizontal, or off-axis (e.g., angled) relative to horizontal and vertical axes. Furthermore, support anchors 204 may be attached to any suitable surface of substrate 206, including a top surface, a bottom surface, or any side surface.

For purposes of this description, it should be understood that references to support anchors 204 being attached to a wall includes support anchors 204 being attached to the wall via any suitable types of intervening components, such as an insulation panel or other intermediate element. Support anchors 204 may be attached to substrate 206 using one or more fasteners 208. Fasteners 208 may include screws, bolts, or any other suitable type of fastener. Support anchors 204 are elongated along an axis 210 such that support anchors 204 run in rail-like fashion along substrate 206 for mounting panels 202 to substrate 206. Additionally, support anchors 204, as attached to substrate 206, may be spaced apart from and, in one example, generally parallel to one another to create areas in which rows of panels 202 may be installed.

Panels 202 may be mounted to substrate 206 via support anchors 204. For example, to mount panel 202*a* to substrate 206, end 212*a* of panel 202*a* is coupled to a support anchor 204*b* and another end 214*a* of panel 202*a* is coupled to support anchor 204*a*. As another example, to mount panel 202*b* to substrate 206, end 212*b* of panel 202*b* is coupled to a support anchor 204*c* and another end 214*b* of panel 202*b* is coupled to support anchor 204*b*.

Each support anchor 204 includes a base 216 for attaching the support anchor 204 to substrate 206. For example, support anchor 204*a* includes base 216*a*, support anchor 204*b* includes base 216*b*, and support anchor 204*c* includes base 216*c*. In certain embodiments, base 216 is a plate-like element designed to lay flat against substrate 206; however, this disclosure contemplates base 216 having any suitable shape/design. Base 216 may include one or more openings for insertion of fasteners 208 to attach support anchor 204 to substrate 206.

Each support anchor 204 includes a projection 218 that extends outwardly from base 216. For example, support anchor 204*a* includes projection 218*a*, support anchor 204*b* includes projection 218*b*, and support anchor 204*c* includes projection 218*c*. As just one example, for a given support anchor 204, projection 218 may extend outwardly from base 216 in a direction away from substrate 206 and may be substantially perpendicular to base 216. As will be described in greater detail below, projection 218 may act as a support shelf for supporting one or more panels 202.

Support anchors 204 may include a tab 220 that extends upwardly from projection 218. For example, tab 220 may extend upwardly from and substantially perpendicularly to projection 218 and may be substantially parallel to base 216 and substrate 206. In certain embodiments, only certain support anchors 204 include tab 220, such as support anchors 204 to which an end 212 (e.g., a lower end) of a panel 202 will be coupled, which may enhance the aesthetic appearance of the installed curtain wall at the top of the installed curtain wall. In the illustrated example of FIG. 2, support anchor 204*b* (e.g., an intermediate support anchor) and support anchor 204*c* (e.g., a bottom support anchor) include tabs 220*b* and 220*c*, respectively, while support anchor 204*a* (e.g., a top support anchor) does not. Tabs 220 may be continuous or discontinuous along support anchor 204.

Support anchors 204 may include a prong 222 that extends from base 216. The prong 222 of a support anchor 204 may be located below the projection 218 of that support anchor 204, for example. In certain embodiments, only certain support anchors 204 include prong 222, such as support anchors 204 to which an end 214 (e.g., an upper end) of a panel 202 will be coupled, which may enhance the aesthetic appearance of the installed curtain wall at the bottom of the installed curtain wall. In the illustrated example of FIG. 2, support anchor 204*a* (e.g., a top support anchor) and support anchor 204*b* (e.g., an intermediate support anchor) include prongs 222*a* and 222*b*, respectively, while support anchor 204*c* (e.g., a bottom support anchor) does not.

In the illustrated example, panels 202 include slots 224 formed in certain edge surfaces, which may facilitate coupling of panels 202 to support anchors 204. For example, panel 202*a* includes a slot 224 that runs along a bottom edge surface at end 212*a* of panel 202*a* and a slot 224 that runs along a top edge surface at end 214*a* of panel 202*a*. As another example, panel 202*b* includes a slot 224 that runs along a bottom edge surface at end 212*b* of panel 202*b* and a slot 224 that runs along a top edge surface at end 214*b* of panel 202*b*. Slots 224 also may be referred to as kerfs. Slots 224 may be formed in any suitable manner, such as using a saw capable of cutting the material of panels 202.

The slot 224 at the lower end 212 of a panel 202 is configured to receive the tab 220 of a support anchor 204 positioned at end 212 of the panel 202 to couple the panel 202 to the support anchor 204 at end 212 of the panel 202. For example, the slot 224 at end 212*a* of panel 202*a* is configured to receive tab 220*b* of support anchor 204*b* positioned at end 212*a* of panel 202*a* to couple panel 202*a* to support anchor 204*b* at end 212*a* of panel 202*a*. As another example, the slot 224 at end 212*b* of panel 202*b* is configured to receive tab 220*c* of support anchor 204*c* positioned at end 212*b* of panel 202*b* to couple panel 202*b* to support anchor 204*c* at end 212*b* of panel 202*b*.

An end 214 (e.g., an upper end) of a panel 202 may couple to a support anchor 204 positioned at end 214 of panel 202 using an interlocking bracket 226. For example, end 214*a* (e.g., an upper end) of panel 202*a* may couple to support anchor 204*a* positioned at end 214*a* of panel 202*a* using an interlocking bracket 226*a*. As another example, end 214*b*

(e.g., an upper end) of panel 202*b* may couple to support anchor 204*b* positioned at end 214*b* of panel 202*b* using an interlocking bracket 226*b*.

The slot 224 at end 214 (e.g., an upper end) of a panel 202 is configured to engage with the interlocking bracket 226, and the interlocking bracket 226 is configured to engage with the prong 222 of the support anchor 204 to which end 214 of panel 202 is being coupled to thereby couple end 214 of panel 202 to support anchor 204. For example, the slot 224 at end 214*a* (e.g., an upper end) of panel 202*a* is configured to engage with interlocking bracket 226*a*, and interlocking bracket 226*a* is configured to engage with prong 222*a* of support anchor 204*a* to thereby couple end 214*a* of panel 202*a* to support anchor 204*a*. As another example, the slot 224 at end 214*b* (e.g., an upper end) of panel 202*b* is configured to engage with interlocking bracket 226*b*, and interlocking bracket 226*b* is configured to engage with prong 222*b* of support anchor 204*b* to thereby couple end 214*b* of panel 202*b* to support anchor 204*b*.

It should be understood that for ease of illustration and visibility, interlocking brackets 226*a* and 226*b* are shown as extending laterally outwardly from side edge surfaces of panels 202*a* and 202*b*, respectively, in slots 224, but that in actual implementation interlocking brackets 226 may be flush with, extend out from, or be internal to the side edge surfaces of panels 202. Additionally, taking panel 202*a* as an example, interlocking bracket 226*a* may extend the full length of slot 224 at end 214*a*, less than the full length of slot 224 at end 214*a*, or greater than the full length of slot 224 at end 214*a*. Furthermore, and again taking panel 202*a* as an example, one or multiple interlocking brackets 226*a* may be used to couple panel 202*a* to support anchor 204*a*. For example, a single interlocking bracket 226*a* may be inserted in slot 224 at end 214*a* (e.g., a top end) of a panel 202*a* or multiple interlocking brackets 226*a* may be inserted at spaced apart locations in slot 224 at end 214*a* of a panel 202*a*.

Additional details of an example manner in which panels 202 are coupled to support anchors 204 for mounting the panels 202 to substrate 206 are shown in and described below with reference to FIGS. 3A-3D.

In certain embodiments, as also will be shown in and described in greater detail with reference to FIGS. 3A-3D, as well as FIGS. 4A-4D and FIG. 5, one or more stabilizing inserts may be inserted in a gap between interlocking bracket 226 and projection 218 of the support anchor 204 to which end 214 of a panel 202 is attached. The one or more stabilizing inserts may further secure panels 202 in position on support anchors 204 over an extended period of time.

In certain embodiments, panel installation system 200 allows panels 202 to be removed (and replaced, if appropriate) individually, reducing or eliminating the need to remove (and replace, if appropriate) numerous panels 202, which may improve efficiency, reduce materials costs (e.g., the cost of multiple replacement panels 202), and reduce the cost of labor (e.g., for the time spent removing, and possibly replacing, multiple panels 202). An example process for removing panels 202 from panel installation system 200 is described in greater detail below with reference to later figures.

Support anchors 204, interlocking brackets 226, and the one or more stabilizing inserts may be made of any suitable materials. As just a few examples, support anchors 204, interlocking brackets 226, and the one or more stabilizing inserts may be made of stainless steel, titanium, structural plastic, aluminum, carbon fiber, silicone, glass, or any other suitable material. Furthermore, support anchors 204, interlocking brackets 226, and the one or more stabilizing inserts may be made of the same materials or some or all of support anchors 204, interlocking brackets 226, and the one or more stabilizing inserts may be made of different materials. In one example, certain elements of panel installation system 200 that are made of stainless steel are made of Society of Automotive Engineers (SAE) 316L stainless steel; however, it should be understood that this is just an example of the type of stainless steel and construction technique that may be used with this disclosure.

The particular material or combination of materials that is appropriate for a particular installation may be determined based on various factors, possibly including the material of panels 202, the environment in which the curtain wall is being installed (e.g., indoors, outdoors on a single-story building, outdoors on a multi-story building), the budget for the project, applicable safety codes, and/or other factors.

In certain embodiments, using support anchors 204, interlocking brackets 226, and/or stabilizing inserts of stainless steel, in combination with the manner in which panels are coupled to support anchors 204, allows panels 202 of heavier materials to be mounted to substrate 206. For example, such heavier panels 202 could potentially include concrete panels 202 weighing many thousands of pounds. This should not be viewed as limiting, as this disclosure contemplates panel installation system 200 being used to install any suitable type of panels 202 in any suitable environment.

In the example illustrated in FIG. 2, panel installation system 200 includes three support anchors 204 (support anchor 204*a*, support anchor 204*b*, and support anchor 204*c*), creating the possibility for two rows of panels 202 to be mounted to substrate 206. This disclosure contemplates a particular installation of panel installation system 200 including any suitable number of support anchors 204. Additionally, although a single top support anchor (e.g., support anchor 204*a*), a single intermediate support anchor (e.g., support anchor 204*b*), and a single bottom support anchor (e.g., support anchor 204*c*) are shown in respective rows, multiple support anchors 204 may be positioned (and attached to substrate 206) end-to-end to allow for extended rows of panels 202 to be mounted to substrate 206.

Furthermore, this disclosure contemplates a particular installation of panel installation system 200 including any suitable number (and possibly zero) of each of top support anchors (e.g., like support anchor 204*a*), intermediate support anchors (e.g., like support anchor 204*b*), and bottom support anchors (e.g., like support anchor 204*c*). For example, a particular installation (or portion of an installation) may include one or more top support anchors (e.g., like support anchor 204*a*) and one or more bottom support anchors (e.g., like support anchor 204*c*), omitting intermediate support anchors (e.g., like support anchor 204*b*), for a single row of panels 202 to be installed. As another example, a particular installation (or portion of an installation) may include multiple parallel rows of intermediate support anchors (e.g., like support anchor 204*b*) between a row of top support anchors (e.g., like support anchor 204*a*) and a row of bottom support anchors (e.g., like support anchor 204*c*), creating the possibility for more than two rows of panels 202 to be installed.

FIGS. 3A-3D illustrate a cross-sectional side view of example aspects of panel installation system 200 in greater detail, as well as a process 300 for mounting a panel 202 to substrate 206 via support anchors 204, according to certain embodiments of this disclosure. For purposes of this example, panel 202*b* is described as being mounted to substrate 206 via support anchor 204*b* (e.g., an intermediate support anchor) and support anchor 204*c* (a bottom support anchor); however, support anchor 204*b* could be replaced with support anchor 204*a* (e.g., a top support anchor) and/or support anchor 204*c* could be replaced with another support anchor 204*b* (e.g., another intermediate support anchor) and the mounting process would operate similarly. Furthermore, process 300 may be repeated to mount additional panels 202 to substrate 206 in the same row and/or in additional rows.

Figure 3A:
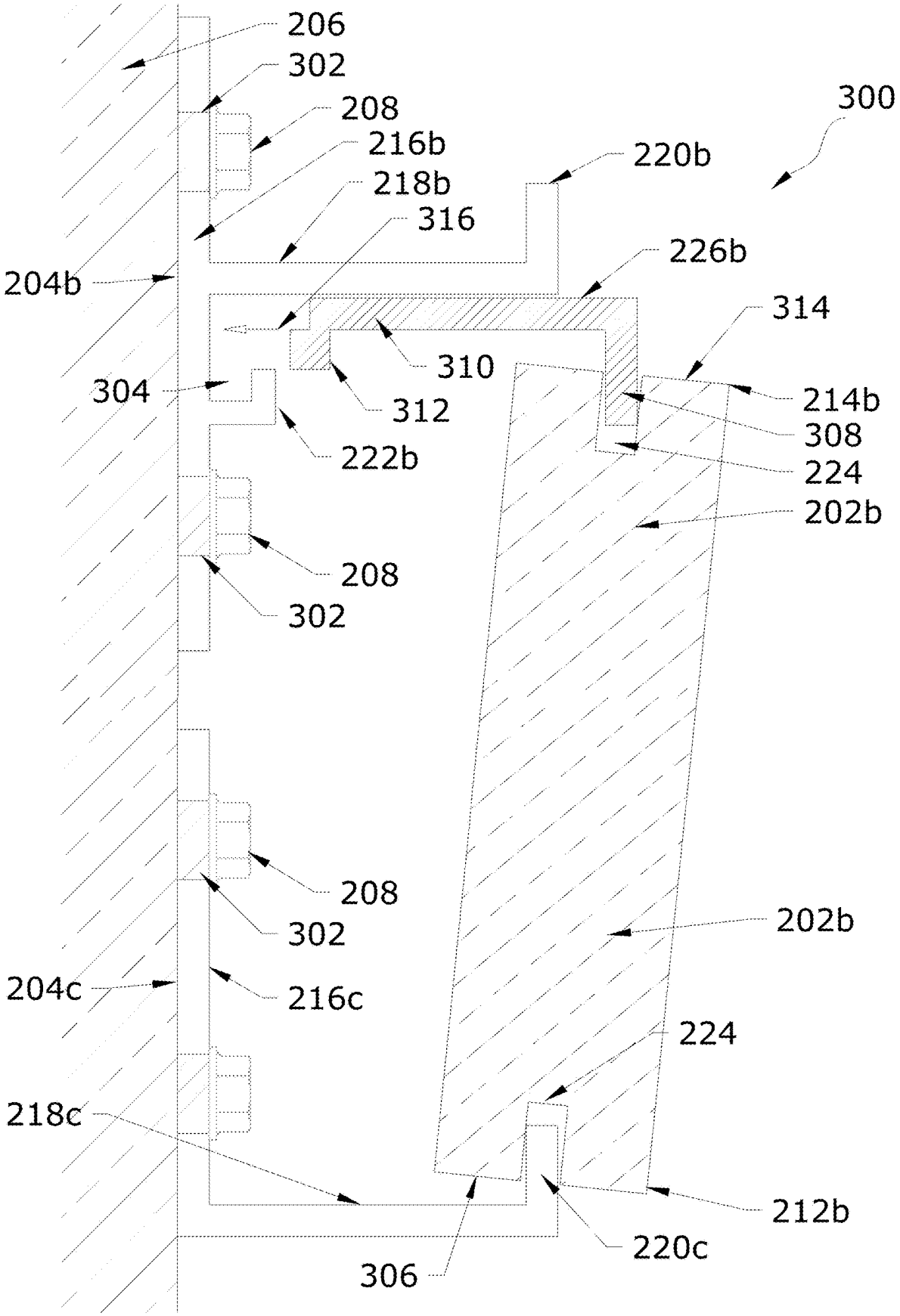
FIGS. 3A-3D illustrate a cross-sectional side view of example aspects of the example curtain wall system of FIG. 2 in greater detail, as well as a process for mounting a panel, according to certain embodiments of this disclosure.

As shown in FIG. 3A, support anchor 204*b* and support anchor 204*c* are attached to substrate 206 using fasteners 208 inserted through apertures 302 in the respective bases 216*b* and 216*c* of support anchor 204*b* and support anchor 204*c*. Support anchors 204*b* and 204*c* may include any suitable number of apertures 302 for attachment of support anchors 204*b* and 204*c* to substrate 206 using fasteners 208, as may be appropriate for particular implementations. Fasteners 208 may include bolts, screws, or any other suitable type of fastener. Support anchors 204*b* and 204*c* are spaced apart from one another and, in certain embodiments, are substantially parallel to one another.

Support anchor 204*b* includes base 216*b* for attaching support anchor 204*b* to substrate 206, projection 218*b* extending outwardly from base 216*b* of support anchor 204*b*, and tab 220*b* extending upwardly from projection 218*b* of support anchor 204*b*. In certain embodiments, projection 218*b* is substantially perpendicular to base 216*b* and tab 220*b* is substantially perpendicular to projection 218*b* and substantially parallel to base 216*b*. In an example in which support anchor 204*b* is replaced with a top support anchor (e.g., support anchor 204*a*), the tab might be omitted.

Support anchor 204*c* includes base 216*c* for attaching support anchor 204*c* to substrate 206, projection 218*c* extending outwardly from base 216*c* of support anchor 204*c*, and tab 220*c* extending upwardly from projection 218*c* of support anchor 204*c*. In certain embodiments, projection 218*c* is substantially perpendicular to base 216*c* and tab 220*c* is substantially perpendicular to projection 218*c* and substantially parallel to base 216*c*.

Support anchor 204*b* further includes prong 222*b* that extends from base 216*b* and is positioned below projection 218*b*. In the illustrated example, prong 222*b* is generally L-shaped and, with a portion of base 216*b*, forms a channel 304 that is generally U-shaped. In another example, prong 222*b* may be a generally linear projection that extends substantially perpendicularly from base 216*b*. The generally linear projection may include a surface (the surface that faces projection 218*b* of support anchor 204*b*) that is designed to mate with another surface (as described further below). One example of such a mating surface is a serrated surface that is designed to mate with another serrated surface, though this disclosure contemplates the surfaces mating in any suitable manner.

End 212*b* (e.g., a bottom end) of panel 202*b* is configured to be coupled to support anchor 204*c*. For example, end 212*b* (e.g., a bottom end) of panel 202*b* may be coupled to support anchor 204*c* by inserting tab 220*c* of support anchor 204*c* into slot 224 that runs along edge surface 306 at end 212*b* of panel 202*b*. Slot 224 that runs along edge surface 306 is configured to receive tab 220*c* of support anchor 204*c*. Although insertion of tab 220*c* of support anchor 204*c* into slot 224 that runs along edge surface 306 is illustrated and described, this disclosure contemplates coupling end 212*b* of panel 202*b* to support anchor 204*c* in any suitable manner. For example, end 212*b* of panel 202*b* may couple to support anchor 204*c* via one or more intermediate components. As a particular example, end 212*b* of panel 202*b* may couple to support anchor 204*c* via a mounting clip. The mounting clip may be coupled to end 212*b* of panel 202*b* and may include a channel into which tab 220*b* of support anchor 204*c* can be inserted. Although such a mounting clip may be implemented in any suitable manner, one particular example of such a mounting clip (mounting apparatus) is described in U.S. Pat. No. 9,631,373 and another particular example of such a mounting clip (clip) is described in U.S. Patent Application Publication 2017/0335564.

As illustrated in FIG. 3A, interlocking bracket 226*b* is coupled to panel 202*b* at end 214*b* (e.g., a top end) of panel 202*b*. Interlocking bracket 226*b* includes leg 308, leg 310, and protrusion 312 at an end of leg 310. In the illustrated example, leg 308 and leg 310 are perpendicular to one another and protrusion 312 has a square-shaped cross-sectional profile. Interlocking bracket 226*b* may be coupled at end 214*b* of panel 202*b* by inserting leg 308 of interlocking bracket 226*b* in slot 224 that runs along edge surface 314 at end 214*b* of panel 202*b*.

End 214*b* of panel 202*b* is moved into position to couple end 214*b* of panel 202*b* to support anchor 204*b*. For example, with interlocking bracket 226*b* coupled at end 214*b*, panel 202*b* may be moved toward substrate 206 generally in direction 316 to engage interlocking bracket 226*b* with prong 222*b* of support anchor 204*b*.

This disclosure contemplates coupling mounting panel 202*b* to substrate 206 via support anchors 204*b* and 204*c* in any suitable manner. That is, this disclosure contemplates coupling end 212*b* of panel 202*b* to support anchor 204*c* and end 214*b* of panel 202*b* to support anchor 204*b* in any suitable manner.

Figure 3B:
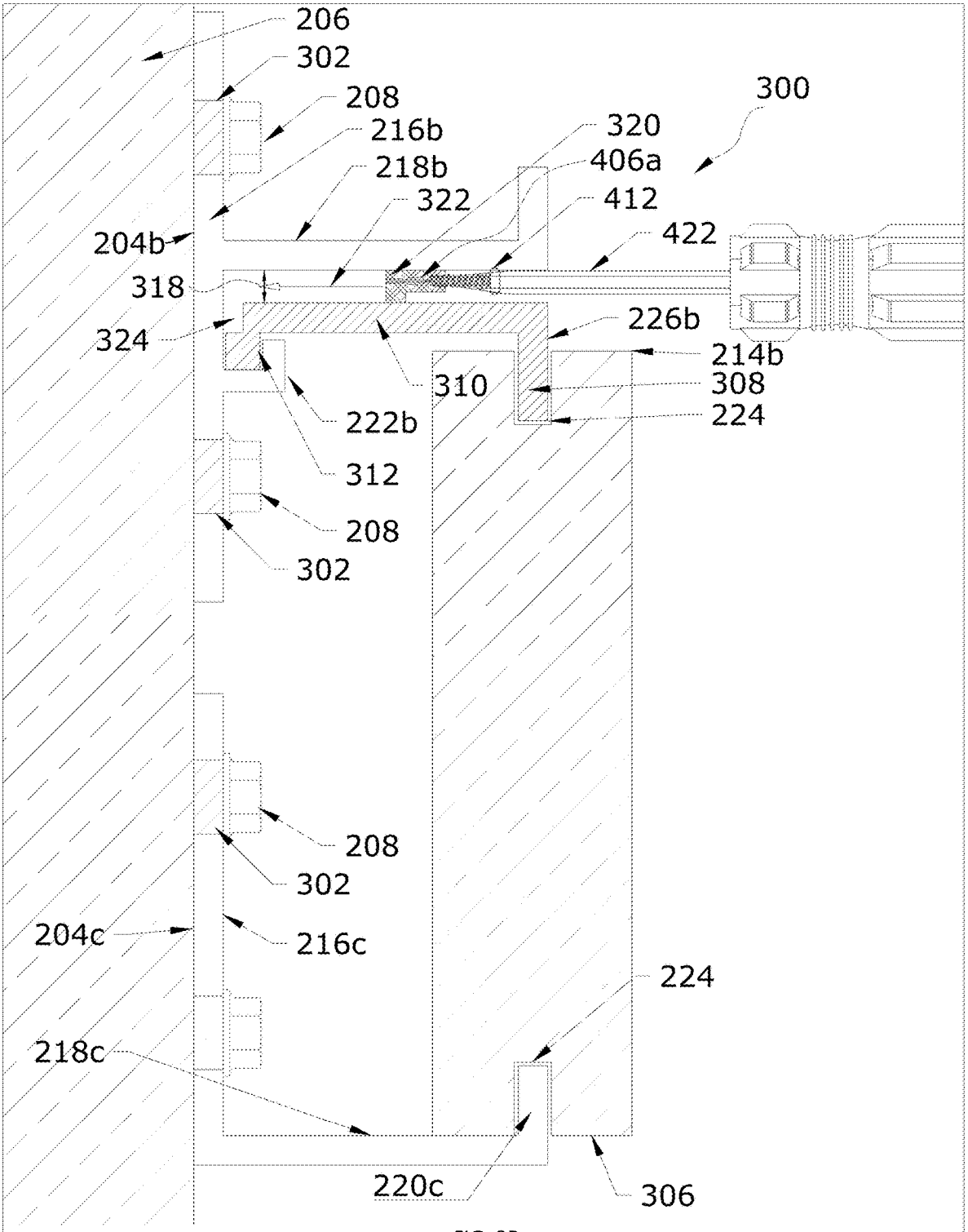

As a first example technique for coupling panel 202*b* to support anchors 204*b* and 204*c* (and as illustrated in FIGS. 3A-3B), panel 202*b* may be lowered at an angle relative to substrate 206 to partially insert tab 220*c* of support anchor 204*c* into slot 224 at end 212*b* of panel 202*b*. As panel 202*b* is lowered such that tab 220*c* of support anchor 204*c* is more fully inserted into slot 224 at end 212*b* of panel 202*b*, panel 202*b* may be rotated toward substrate 206 until interlocking bracket 226*b* (coupled to end 214*b* of panel 202*b*, as described above) engages with prong 222*b* (e.g., protrusion 312 of interlocking bracket 226*b* is seated in channel 304) and tab 220*c* is fully inserted in slot 224 at lower end 212*b* of panel 202*b*. It should be understood that tab 220*c* being fully inserted in slot 224 at lower end 212*b* of panel 202*b* might or might not include tab 220*c* contacting a bottom of slot 224 at lower end 212*b* of panel 202*b*.

As a second example technique for coupling panel 202*b* to support anchors 204*b* and 204*c*, with interlocking bracket 226*b* coupled to end 214*b* of panel 202*b* and panel 202*b* positioned substantially parallel to substrate 206, panel 202*b* may be positioned such that interlocking bracket 226*b* (e.g., leg 310 and protrusion 312 of interlocking bracket 226*b*) is aligned with a gap between prong 222*b* and projection 218*b* and such that end 212*b* of panel 202*b* can clear tab 220*c* (e.g., is "higher" than tab 220*c*). Panel 202*b* then may be moved toward substrate 206 in a direction generally perpendicular to substrate 206 until protrusion 312 is above and aligned with channel 304 of prong 222*b* and slot 224 at end 212*b* of panel 202*b* is "over" and aligned with tab 220*c*. Panel 202*b* then may be "lowered" until interlocking bracket 226*b* engages with prong 222*b* (e.g., protrusion 312 is seated in channel 304 of prong 222*b*) and tab 220*c* is inserted in slot 224 at end 212*b* of panel 202*b*. In certain embodiments, for this installation technique to be possible, certain components would be appropriately sized and arranged so that protrusion 312 of interlocking bracket 226*b* can clear prong 222*b* and end 212*b* of panel 202*b* can clear tab 220*c* as panel 202*b* is moved toward substrate 206 prior to lowering panel 202*b* for interlocking bracket 226*b* to engage with prong 222*b* (e.g., protrusion 312 to be seated in channel 304) and tab 220*c* to be inserted in slot 224 at end 212*b* of panel 202*b*.

Turning to FIG. 3B, FIG. 3B illustrates a state in which panel 202*b* is mounted to substrate 206, with end 212*b* of panel 202*b* coupled to support anchor 204*c* and end 214*b* of panel 202*b* coupled to support anchor 204*b*. As shown in FIG. 3B, tab 220*c* of support anchor 204*c* is inserted in slot 224 at end 212*b* of panel 202*b*. In certain embodiments, slot 224 is sufficiently deep such that a portion of edge surface 306 that is located between tab 220*c* and base 216*b* rests on projection 218*c*. In this way, projection 218*c* may function as a shelf on which panel 202*b* rests. Alternatively, if slot 224 is not sufficiently deep, a base of slot 224 may rest on tab 220*c*. In either scenario, support anchor 204*c* supports at least a portion of the dead load of panel 202*b*.

As shown in FIG. 3B, end 214*b* of panel 202*b* is coupled to support anchor 204*b*, with interlocking bracket 226*b* engaged with prong 222*b* of support anchor 204*b*. Interlocking bracket 226*b* may be engaged with prong 222*b* by seating protrusion 312 of interlocking bracket 226*b* (e.g., at an end of leg 310) in channel 304 formed by prong 222*b*. As described above with reference to FIG. 3A, in the illustrated example, channel 304 is generally U-shaped and protrusion 312 has a square-shaped cross-sectional profile. It should be understood that this is for example purposes only. In certain embodiments, the shape of channel 304 and the shape of protrusion 312 can be designed to be any complementary shapes such that channel 304 formed by prong 222*b* is able to receive protrusion 312 of interlocking bracket 226*b* and protrusion 312 of interlocking bracket 226*b* is able to be seated within channel 304.

In another example, as described above, prong 222*b* may be a generally linear projection that extends substantially perpendicularly from base 216*b* and has a surface (the surface that faces projection 218*b* of support anchor 204*b*) that is designed to mate with another surface. In such an example, protrusion 312 may have a surface (e.g., the surface that faces prong 222*b*) that is designed to mate with the mating surface of the generally linear projection of prong 222*b*. As just one example, both surfaces may be complementarily serrated. As another example, protrusion 312 of interlocking bracket 226*b* may be omitted and a surface of leg 310 that faces prong 222*b* may be designed to mate with the mating surface of the generally linear projection of prong 222*b* (e.g., with both surfaces being complementarily serrated).

Engagement of interlocking bracket 226*b* with prong 222*b* (interlocking bracket 226*b* also being coupled to panel 202*b* through the insertion of leg 308 in slot 224 at end 214*b* of panel 202*b*) facilitates holding panel 202*b* in position, mounted to substrate 206, and inhibiting panel 202*b* from de-coupling from support anchor 204*b*, and potentially from support anchor 204*c*.

Although insertion of leg 308 of interlocking bracket 226*b* into slot 224 at end 214*b* of panel 202*b* is illustrated and described, this disclosure contemplates coupling end 214*b* of panel 202*b* to support anchor 204*b* via interlocking bracket 226*b* in any suitable manner. For example, end 214*b* of panel 202*b* may couple to interlocking bracket 226*b* via one or more intermediate components. As a particular example, end 214*b* of panel 202*b* may couple to interlocking bracket 226*b* via a mounting clip. The mounting clip may be coupled to end 214*b* of panel 202*b* and may include a channel into which leg 308 of interlocking bracket 226*b* can be inserted. Although such a mounting clip may be implemented in any suitable manner, one particular example of such a mounting clip (mounting apparatus) is described in U.S. Pat. No. 9,631,373 and another particular example of such a mounting clip (clip) is described in U.S. Patent Application Publication 2017/0335564.

With panel 202*b* mounted to substrate 206 via support anchors 204*b* and 204*c*, a gap 318 is present between leg 310 of interlocking bracket 226*b* and projection 218*b* of support anchor 204*b*. In certain embodiments, it may be desirable to more securely hold panel 202*b* in position on support anchors 204*b* and 204*c* by positioning one or more stabilizing insert in gap 318.

Figure 3C:
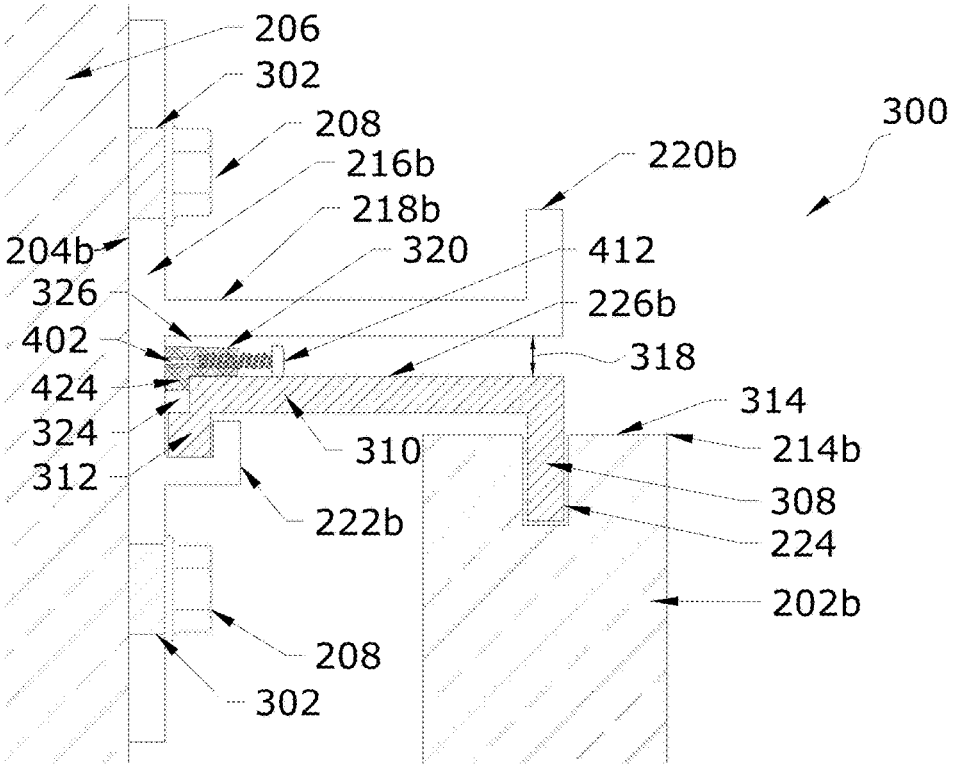
Figure 3D:
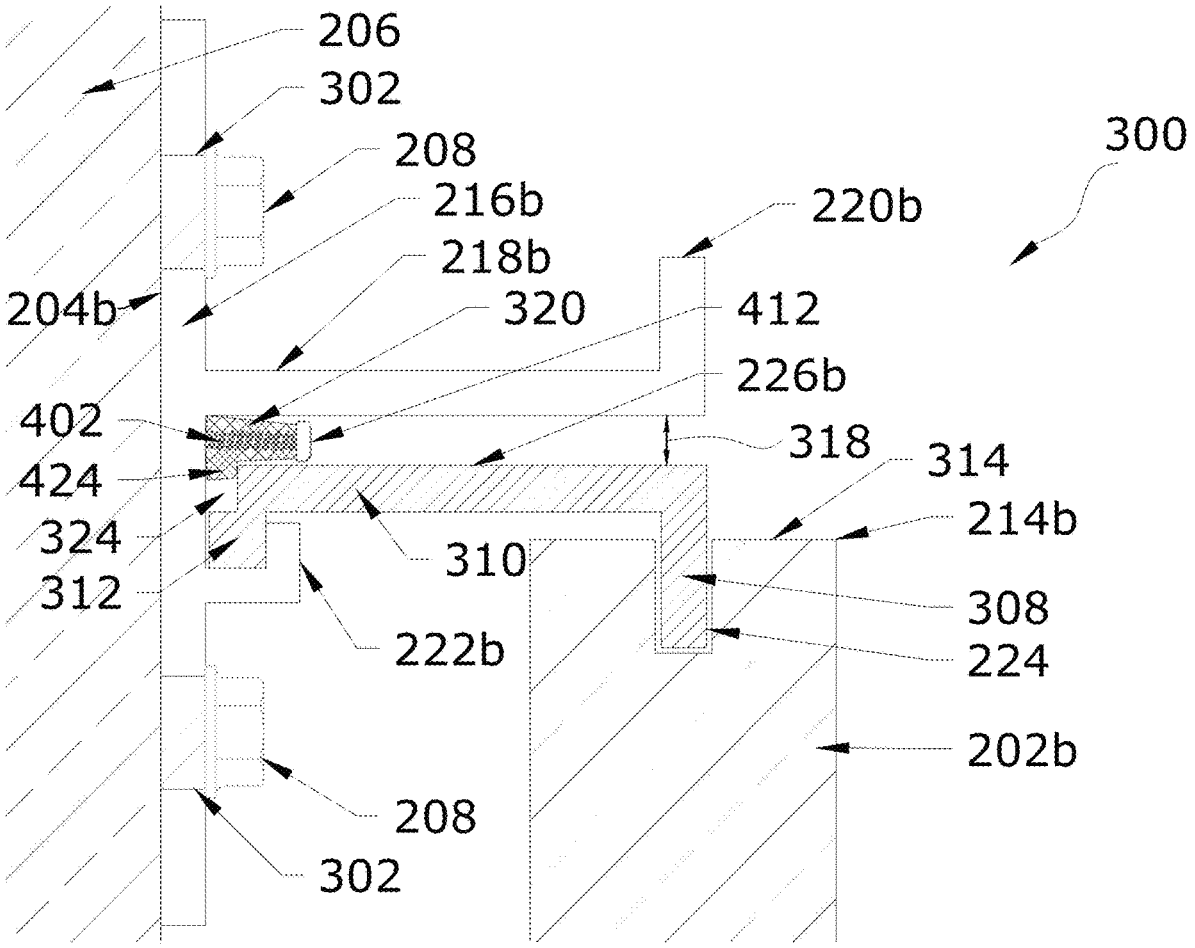

As shown in FIGS. 3B-3D, a locking clip 320 may be inserted in gap 318, which may further secure panel 202*b* in position on support anchors 204*b* and 204*c*. That is, in the illustrated example, the one or more stabilizing inserts are implemented as locking clip 320. Details of an example implementation of locking clip 320 are described below with reference to FIGS. 4A-4B before returning to FIG. 3B to continue describing process 300.

Figure 4A:
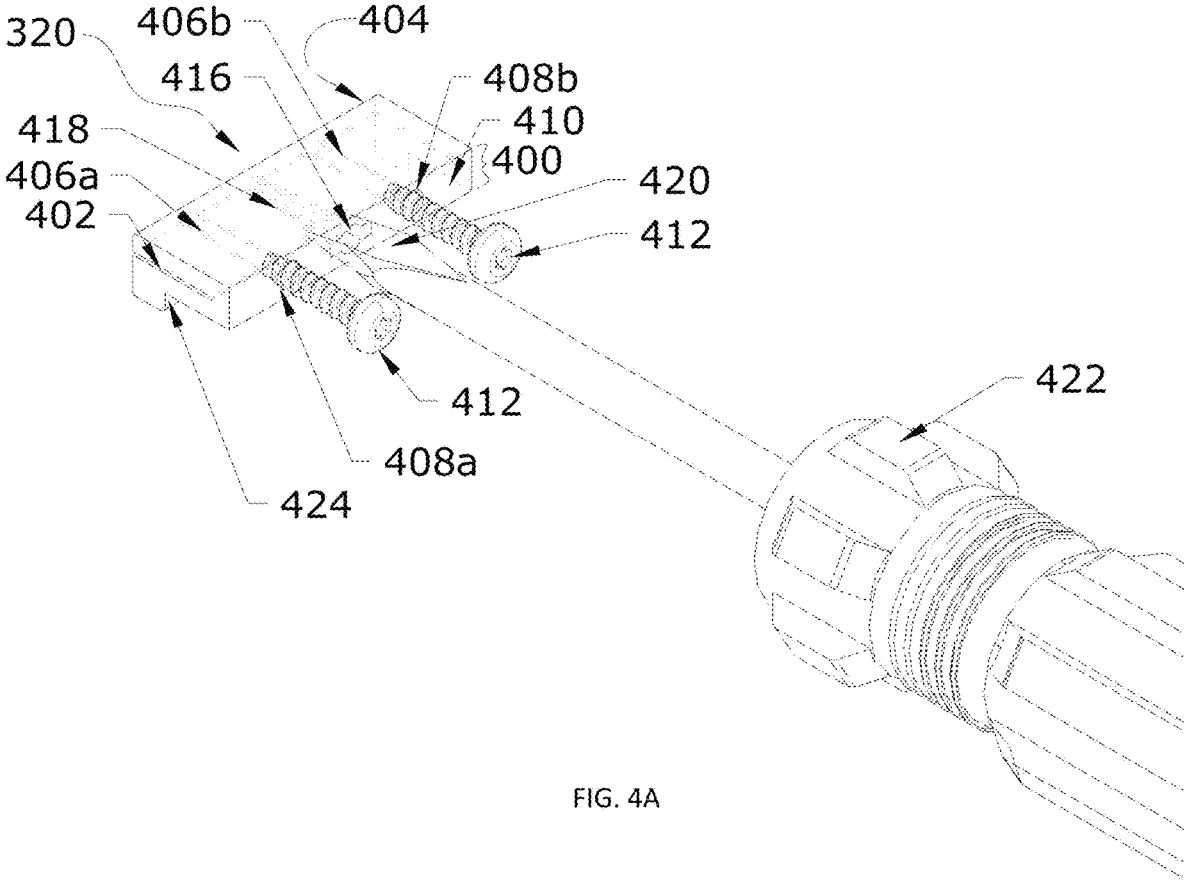
FIGS. 4A-4B illustrate isometric views of an example locking clip, according to certain embodiments of this disclosure.
Figure 4B:
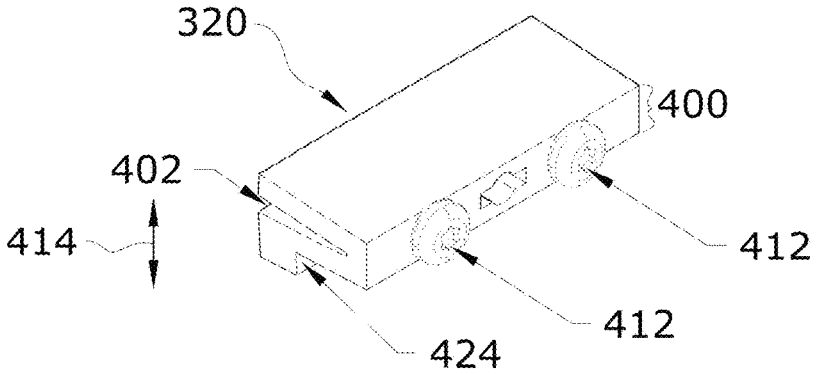

FIGS. 4A-4B illustrate isometric views of an example locking clip 320, according to certain embodiments of this disclosure. In particular, FIG. 4A illustrates an isometric view of locking clip 320 with portions of locking clip 320 being transparent to show an example of the internal construction of locking clip 320, and prior to an expansion of locking clip 320. FIG. 4B illustrates an isometric view of locking clip 320 after expansion of locking clip 320. It should be understood that locking clip 320 illustrates just one example of how locking clip 320 may be implemented.

Locking clip 320 includes body 400. In certain embodiments, body 400 is a cuboid; however, body 400 may take other shapes suitable for fitting in gap 318. Body 400 includes an articulation notch 402 running a length of body 400, as best seen in FIG. 4A. Articulation notch 402 is open to a first edge surface 404 of body 400, and along a portion of side surfaces of body 400.

Body 400 as shown in FIG. 4A includes narrowing cavities 406*a* and 406*b*. Narrowing cavities 406*a* and 406*b* have respective apertures 408*a* and 408*b* in a second edge surface 410 of body 400. Second edge surface 410 may be opposite first edge surface 404. Although narrowing cavities 406*a* and 406*b* may have any suitable shape, in certain embodiments, narrowing cavities 406*a* and 406*b* are conical, which may be suitable for receiving a screw or other rounded elongated element. Although a particular number of narrowing cavities 406 are illustrated, body 400 may include any suitable number of narrowing cavities 406.

Apertures 408*a* and 408*b* are configured to receive respective elongated elements 412. Elongated elements 412 may be screws, for example. Insertion of elongated elements 412 in respective narrowing cavities 406 (e.g., narrowing cavities 406*a* and 406*b*) via respective apertures 408 (e.g., apertures 408*a* and 408*b*) causes articulation notch 402 to open and locking clip 320 to expand, generally in direction 414. FIG. 4B shows a state of locking clip 320 in which elongated elements 412 have been fully inserted in narrowing cavities 406*a* and 406*b* via apertures 408*a* and 408*b*, respectively, and articulation notch 402 has opened causing locking clip 320 to expand in direction 414. In the expanded state in this example, locking clip 320 becomes somewhat wedge shaped.

Locking clip 320 may include an insertion tool opening 416 and associated insertion tool cavity 418, which are shaped for receiving an end portion 420 of an insertion tool 422 for positioning locking clip 320 in gap 318. The shape of insertion tool opening 416 may extend at least partially into body 400, such that insertion tool cavity 418 includes a portion having the shape of insertion tool opening 416, allowing insertion tool 422 to be inserted into body 400. Insertion tool cavity 418 also may include a portion that narrows in a generally similar manner to narrowing cavities 406*a* and 406*b*, if desired.

Locking clip 320 includes tab 424, which extends from body 400 and is configured to be oriented toward interlocking bracket 226*b* as locking clip 320 is positioned in gap 318. Even with tab 424 extending from body 400, locking clip 320 is adapted to fit in and slide through gap 318.

Returning to FIG. 3B, locking clip 320 may be inserted in gap 318 and moved in direction 322 to a target position (shown in FIGS. 3C, 3D, and 5, described below), which may further secure panel 202*b* in position on support anchor 204*b*, as well as on support anchor 204*c*, inhibiting panel 202*b* from de-coupling from support anchor 204*b*, as well as potentially from support anchor 204*c*. As shown in FIG. 3B, locking clip 320 may be moved in direction 322 in gap 318 by sliding locking clip 320 in direction 322 in gap 318, using insertion tool 422 for example. The target position of locking clip 320 in gap 318 may depend on the particular implementation of locking clip 320 (and possibly the particular implementation of interlocking bracket 226*b*), of which the illustrated example locking clip 320 is just one example.

In certain embodiments, leg 310 and protrusion 312 of interlocking bracket 226*b* define a slot 324. In the illustrated example, slot 324 is at an end of leg 310 between the end of leg 310 and base 216*b* of support anchor 204*b*. Slot 324 is adapted to receive tab 424 of locking clip 320 once locking clip 320 is inserted into position in gap 318. In certain embodiments, locking clip 320 is slid in gap 318 (e.g., using insertion tool 422) until tab 424 is received by slot 324. Thus, slot 324 may serve as a locator for finding the target position of locking clip 320, while also helping to maintain locking clip 320 in position in gap 318.

FIG. 3C illustrates a state in which locking clip 320 is positioned in the target position, and in which locking clip 320 is in the process of being expanded. In particular, locking clip 320 has been moved through gap 318 until slot 324 has received tab 424 of locking clip 320. With respect to both FIGS. 3C and 3D, for ease of focusing on, in part, the engagement of interlocking bracket 226*b* with prong 222*b* and placement and operation of locking clip 320, the lower portion of panel 202*b* and the engagement of panel 202*b* with support anchor 204*c* are omitted. In one example, the engagement of panel 202*b* with support anchor 204*c* remains in a state substantially similar to that shown in FIG. 3B throughout the installation steps shown in FIGS. 3C and 3D.

As shown in FIG. 3C, with locking clip 320 in the target position, a gap 326 is present between locking clip 320 and projection 218*b* of support anchor 204*b*. Thus, while locking clip 320 closed some of gap 318, gap 326 remains. Locking clip 320 is configured to be expanded, which may close some or all of gap 326. It should be noted that in the illustrated example, expansion of locking clip 320 already is underway, such that gap 326 illustrates only a portion of the gap that exists between locking clip 320 and projection 218*b* of support anchor 204*b* after locking clip 320 is moved into the target position and prior to expansion of locking clip 320.

An elongated element 412 is inserted into narrowing cavity 406*a* via aperture 408*a* (shown in FIGS. 4A-4B), causing articulation notch 402 to open and locking clip 320 to expand in gap 318 and also causing gap 326 to be reduced or eliminated (as described below with reference to FIG. 3D). For example, elongated element 412 may be a screw and elongated element 412 may be driven into narrowing cavity 406*a* by twisting elongated element 412 using an appropriately-shaped screwdriver. Using a removable elongated element 412, such as a screw, may provide certain advantages, as described below. As shown in FIGS. 4A-4B, multiple elongated elements 412 may be inserted into corresponding narrowing cavities 406 to facilitate expansion of locking clip 320.

FIG. 3D illustrates a state in which elongated element 412 has been inserted to a desired depth (possibly fully inserted) in narrowing cavity 406*a* and locking clip 320 has expanded in gap 318, reducing or eliminating gap 326. In one example, locking clip 320 expands such that locking clip 320 contacts projection 218*b* of support anchor 204*b*.

In certain embodiments, engagement of tab 424 of locking clip in slot 324 and expansion of locking clip 320 in gap 318 between interlocking bracket 226*b* and projection 218*b* of support anchor 204*b* inhibits removal of locking clip 320 from gap 318, thereby further securing panel 202*b* in position on support anchor 204*b*, and potentially from support anchor 204*c*.

A filler material, such as silicone or another suitable substance, may be applied at various locations of curtain wall system and at various points of process 300. For example, the filler material may be deposited in slot 224 at end 212*b* (e.g., a lower end) of panel 202*b* prior to inserting tab 220*c* in slot 224 at end 212*b* of panel 202*b*. As another example, the filler material may be deposited in slot 224 at end 214*b* (e.g., an upper end) of panel 202*b* prior to inserting leg 308 of interlocking bracket 226*b* in slot 224 at end 214*b* (e.g., an upper end) of panel 202*b*. As another example, the filler material may be deposited in prong 222*b* prior to engaging interlocking bracket 226*b* with prong 222*b*. As another example, the filler material may be deposited in gap 318 prior to positioning locking clip 320 in gap 318. As another example, the filler material may be deposited in gap 318 after positioning locking clip 320 in gap 318.

The filler material may serve a variety of purposes. For example, the filler material may serve as a sealant, where applied, to facilitate moisture control in panel installation system 200. As another example, the filler material may serve as an adhesive, helping to stabilize panel installation system 200. As another example, the filler material may be sufficiently flexible to allow for thermal expansion in panel installation system 200 and to accommodate vibration/shifting of panel installation system 200 due to seismic activity. It should be understood, however, that the filler material might or might not be used without departing from the scope of this disclosure.

FIGS. 3A-3D illustrate an example in which the one or more stabilizing inserts of panel installation system 200 are implemented as one or more locking clips 320. This disclosure, however, contemplates implementing the one or more stabilizing inserts of panel installation system 200 in any suitable manner. The one or more stabilizing inserts may be implemented as any suitable component or components that are configured to partially or completely close gap 318 to further secure panel 202*b* in position on support anchor 204*b* and support anchor 204*c*. As a first example, the above-described filler material could serve as the one or more stabilizing insert in certain implementations. As another example, the one or more stabilizing inserts may be one or more screws inserted in gap 318, potentially screwed into substrate 206 through support anchor 204*b*, with the screw head substantially closing gap 318. As yet another example, the one or more stabilizing inserts may be one or more locking clips that have a different design that locking clips 320. As just one alternative locking clip design, a locking clip may include two stacking and interlocking bars that have threaded cavities (e.g., similar to narrowing cavities 406*a* and 406*b*) that cause a top plate to spread apart from a bottom plate in a parallel fashion rather than opening in the wedge-like fashion of locking clip 320. In this alternative example, the interaction of the alternative locking clip with a support anchor (e.g., support anchor 204*b*) and interlocking bracket (e.g., interlocking bracket 226*b*) are similar to the interaction described with respect to locking clip 320.

Additionally, certain embodiments of interlocking brackets 226 (and, to continue with the above-described example, interlocking bracket 226*b* might omit slot 324 or might include a differently-shaped slot 324. For example, whether or not to include slot 324 in interlocking bracket 226*b* (and, to the extent included, the shape of slot 324) may depend on the particular implementation of the one or more stabilizing inserts. For example, if the filler material will serve as a stabilizing insert, it may be possible to omit slot 324, if desired. As another example, if one or more screws will serve as the one or more stabilizing inserts, it also may be possible to omit slot 324, if desired. As yet another example, if the one or more stabilizing inserts are implemented as a locking clip that has a different design that locking clip 320 (e.g., that has a differently-shaped tab 424, then slot 324 may have a different shape than the shape illustrated in FIGS. 3A-3D.

Process 300 may be used to install multiple panels 202, potentially in a field of panels 202 (e.g., panel field 102). Furthermore, process 300 may allow panels 202 to be installed in a non-sequential manner, as the installation of one panel 202 does not depend on the installation of any other panel 202 in the field of panels 202.

In certain embodiments, panel installation system 200 allows individual panels 202 to be removed, even after a panel 202 is surrounded by other installed panels 202, possibly without breaking or otherwise damaging panels 202. An example technique for removing panel 202*b* is described below.

In an example embodiment, elongated elements 412 are removed from locking clip 320, which is in position and expanded in gap 318. Elongated elements 412 may be accessed through gap 318. In an example in which elongated elements 412 are screws, elongated elements 412 are unscrewed using a screwdriver of sufficient length to reach elongated elements 412 through gap 318. To the extent multiple locking clips 320 are used to secure panel 202*b*, the elongated elements 412 for all such locking clips 320 are removed.

Locking clip 320 may then be removed via gap 318. In certain embodiments, locking clip 320 is at least somewhat resilient such that if elongated elements 412 are removed, articulation notch 402 closes at least partially, allowing locking clip 320 to be moved (e.g., slid) back through gap 318 to remove locking clip 320. Again, to the extent multiple locking clips 320 are used to secure panel 202*b*, each of the locking clips 320 is removed via gap 318.

This disclosure contemplates removing locking clip 320 in any suitable manner. In one example, a screw of sufficient length to be secured to locking clip 320 through gap 318 may be inserted in insertion tool opening 416 (or another suitable opening in first edge surface 410 of body 400 of locking clip 320) through gap 318. Using a screwdriver, the screw may be rotated a suitable number of turns to be secured to locking clip 320 (e.g., in insertion tool cavity 418), and then the screw may be pulled to remove locking clip 320. As another example, insertion tool 422 may be configured to also act as a removal tool and may be used to remove locking clip 320. For example, insertion tool opening 416 and insertion tool cavity 418 may have a suitable shape such that end portion 420 of insertion tool may be inserted and rotated to lock in position, allowing insertion tool 422 to be used to both push and pull locking clip 320, as desired.

To the extent another type of stabilizing insert is used in place of or in addition to locking clip(s) 320, the stabilizing insert is removed. If more than one stabilizing insert is used, the additional stabilizing inserts also are removed.

With the one or more locking clips 320 removed, panel 202*b* may be dismounted from substrate 206. That is, end 214*b* of panel 202*b* may be decoupled from support anchor 204*b* by disengaging interlocking bracket 226*b* from prong 222*b* and end 212*b* of panel 202*b* may be decoupled from support anchor 204*c*.

As a first example technique for decoupling panel 202*b* from support anchors 204*b* and 204*c* (and essentially a reversal of the above-described first example technique for coupling panel 202*b* to support anchors 204*b* and 204*c*, as illustrated example of FIGS. 3A-3B), panel 202*b* may be lifted vertically such that tab 220*c* is partially removed from slot 224 at end 212*b* of panel 202*b* and interlocking bracket 226*b* disengages from prong 222*b*. For example, panel 202*b* may be lifted vertically at least a sufficient amount for protrusion 312 of interlocking bracket 226*b* to, in a subsequent act, clear the gap between prong 222*b* and projection 218*b* of support anchor 204*b* (e.g., the physical attributes of this gap and interlocking bracket 226*b* being configured to allow protrusion 312 of interlocking bracket 226*b* to clears this gap), or for complementary mating surfaces of prong 222*b* and interlocking bracket 226*b* (e.g., protrusion 312) to disengage.

Continuing with this first example technique for decoupling panel 202*b* from support anchors 204*b* and 204*c*, panel 202*b* then may be rotated away from substrate 206 until panel 202*b* may be lifted at an angle vertically and away from substrate 206 such that tab 220*c* is fully removed from slot 224 at end 212*b* of panel 202*b* to dismount panel 202*b*. For example, panel 202*b* first may be rotated away from substrate 206 until protrusion 312 of interlocking bracket 226*b* clears the gap between prong 222*b* and projection 211*b* of support anchor 204*b* (e.g., the physical attributes of this gap and interlocking bracket 226*b* being configured to allow protrusion 312 of interlocking bracket 226*b* to clears this gap) and until panel 202*b* is able to be lifted at an angle vertically and away from substrate 206 to fully remove tab 220*c* from slot 224 at end 212*b* of panel 202*b*. Panel 202*b* then may be lifted at an angle vertically and away from substrate 206 such that tab 220*c* is fully removed from slot 224 at end 212*b* of panel 202*b* to dismount panel 202*b*.

As a second example technique for decoupling panel 202*b* from support anchors 204*b* and 204*c* (and essentially a reversal of the above-described second example technique for coupling panel 202*b* to support anchors 204*b* and 204*c*), panel 202*b* may be lifted vertically such that tab 220*c* is removed from slot 224 at end 212*b* of panel 202*b* and interlocking bracket 226*b* disengages from prong 222*b*, and panel 202*b* may be pulled in a direction generally perpendicular to substrate 206 to dismount panel 202*b*.

In either example decoupling process, in certain embodiments, panel 202*b* is able to be decoupled from support anchors 204*b* and 204*c* without breaking or otherwise damaging panel 202*b*. Furthermore, panel 202*b* may be a panel 202 that is in a field of panels 202 (e.g., panel field 102), including in the middle of the field of panels 202, and in certain embodiments panel 202*b* may be removed not only without damaging panel 202*b*, but also without damaging and with little to no impact on other panels 202 in the field of panels 202. Additionally, depending on the type of installation, the ability to remove and replace/reinstall individual panels 202 may allow items covered by panels 202 to be serviced efficiently and at relatively low cost.

If a replacement panel 202 is to be installed in place of removed panel 202*b*, process 300 may be followed to install the replacement panel 202. Furthermore, because panel 202 may be removed without breaking or otherwise damaging panel 202, replacing panel 202 may be reinstalling the same panel 202 that was removed, which over time may reduce costs associated with purchasing new replacement panels 202 and may reduce or eliminate delays associated with obtaining new replacement panels 202.

Figure 5:
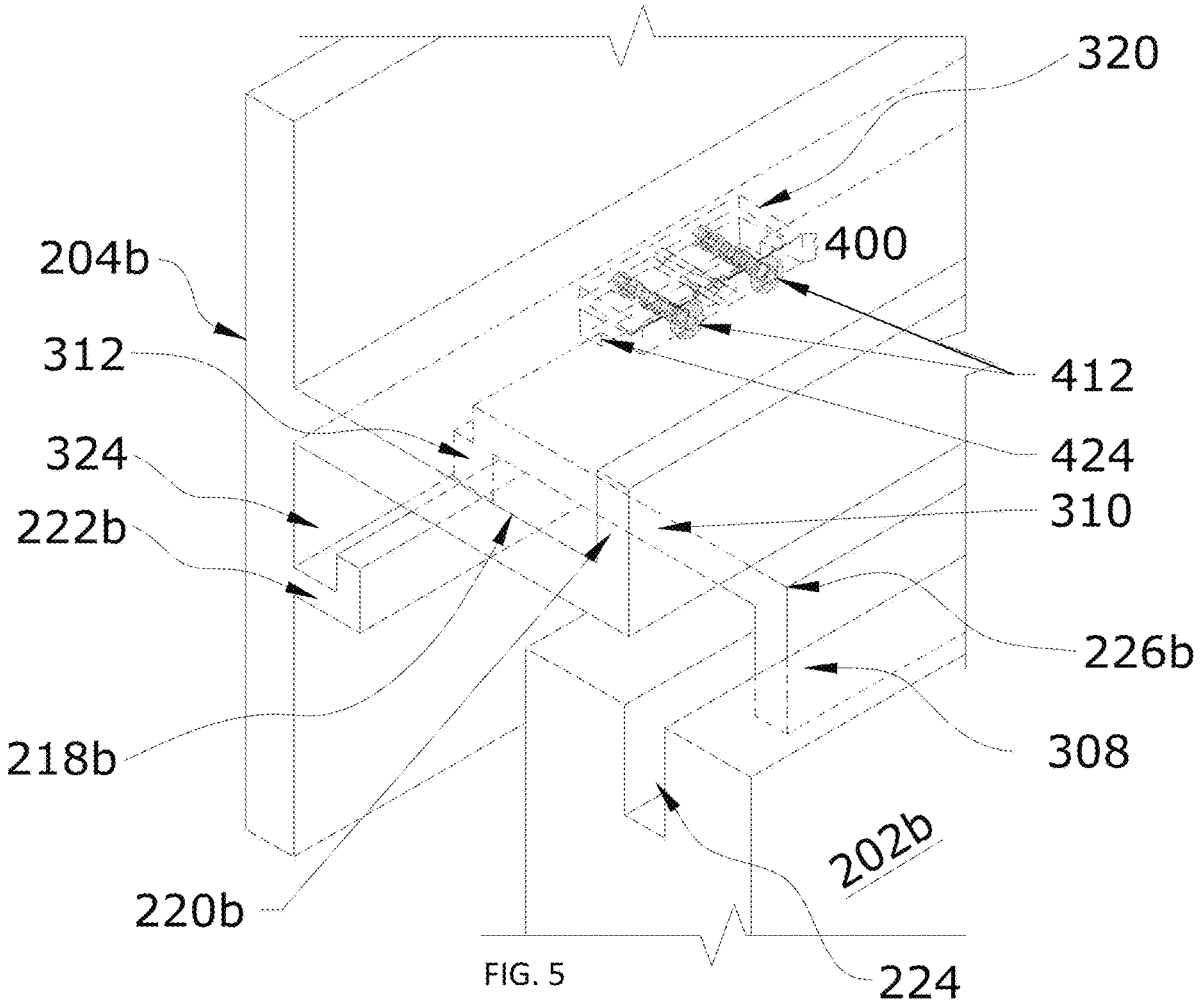
FIG. 5 illustrates an isometric view of the example locking clip of FIGS. 4A-4B in position and expanded, according to certain embodiments of this disclosure.

FIG. 5 illustrates an isometric view of locking clip 320 in position and expanded in gap 318, according to certain embodiments of this disclosure. FIG. 5 generally corresponds to the installation state shown in and described with respect to FIG. 3D. To simplify the view shown in FIG. 5, various elements are not shown, including for example, substrate 206. Although a single locking clip 320 is illustrated, one or multiple locking clips 320 may be positioned in gap 318 for a particular panel 202. Furthermore, locking clip 320 may be wider or narrower than the illustrated locking clip 320.

Figure 6:
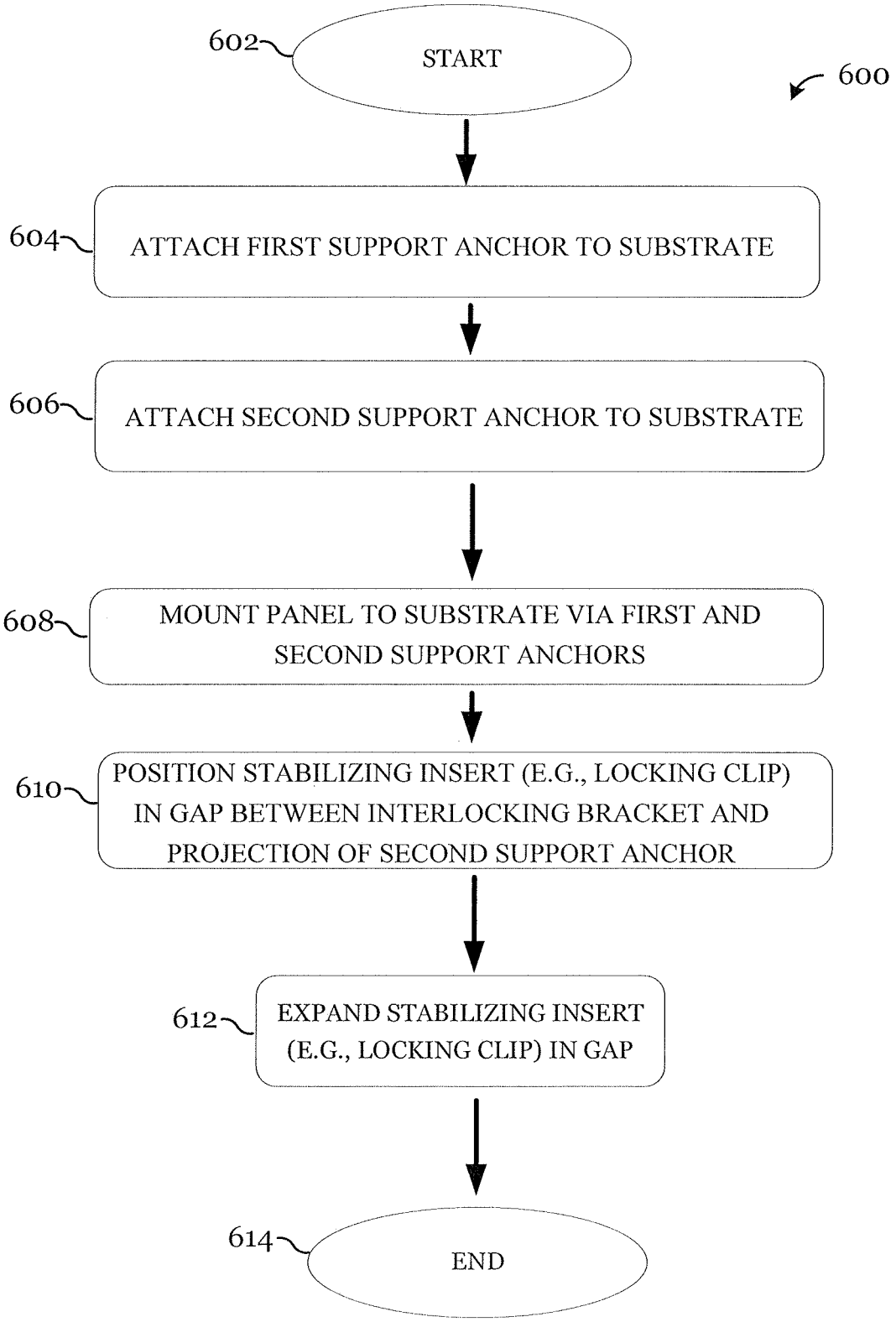
FIG. 6 illustrates an example method for installing a panel, according to certain embodiments of this disclosure.

FIG. 6 illustrates an example method 600 for installing a panel 202, according to certain embodiments of this disclosure. For purposes of this example, the panel being installed is panel 202*b*, which is being mounted to support anchors 204*b* and 204*c*. The method begins at step 602.

At step 604, support anchor 204*c* is attached to substrate 206 (e.g., a wall). Support anchor 204*c* is elongated and includes base 216*c* for attaching support anchor 204*c* to substrate 206. Projection 218*c* extends outwardly from base 216*c* and tab 220*c* extends upwardly from projection 218*c*. Support anchor 204*c* may be attached to substrate 206 by one or more fasteners 208 inserted through corresponding apertures 302 in base 216*c* of support anchor 204*c*.

At step 606, support anchor 204*b* is attached to substrate 206 (e.g., a wall) spaced apart from and, in certain embodiments, substantially parallel to support anchor 204*c*. Support anchor 204*b* is elongated and includes base 216*b* for attaching support anchor 204*b* to substrate 206. Projection 218*b* extends outwardly from base 216*b* of support anchor 204*b*, and prong 222*b* extends from base 216*b*. Support anchor 204*b* may be attached to substrate 206 by one or more fasteners 208 inserted through corresponding apertures 302 in base 216*b* of support anchor 204*b*.

At step 608, panel 202*b* is mounted to substrate 206 (e.g., a wall) via support anchor 204*c* and support anchor 204*b*. Mounting panel 202*b* may include coupling end 212*b* of panel 202*b* to support anchor 204*c*. In certain embodiments, coupling end 212*b* of panel 202*b* to support anchor 204*c* includes inserting tab 220*c* of support anchor 204*c* into slot 224 that runs along edge surface 306 at end 212*b* of panel 202*b*.

Mounting panel 202*b* also may include coupling interlocking bracket 226*b* to end 214*b* of panel 202*b*, and coupling end 214*b* of panel 202*b* to support anchor 204*b* by engaging interlocking bracket 226*b* with prong 222*b* of support anchor 204*b*. In certain embodiments, coupling interlocking bracket 226*b* to end 214*b* of panel 202*b* includes inserting the leg 308 into slot 224 that runs along edge surface 314 at end 214*b* of panel 202*b*. In certain embodiments, engaging interlocking bracket 226*b* with prong 222*b* includes seating protrusion 312 at the end of leg 310 in channel 304 formed by prong 222*b*.

At step 610, one or more locking clips 320 (and/or one or more other types of stabilizing inserts) are positioned in gap 318 between interlocking bracket 226*b* and projection 218*b* of support anchor 204*b*. For example, locking clip 320 may be inserted (e.g., slid) in gap 318 until tab 424 of locking clip 320 is received by slot 324. In certain embodiments, positioning locking clip 320 in gap 318 includes inserting a portion (e.g., an end portion 420) of insertion tool 422 in insertion tool cavity 418 via insertion tool opening 416 and sliding locking clip 320 in gap 318 by pushing on insertion tool 422.

At step 612, locking clip 320 is expanded in gap 318. For example, one or more elongated elements 412 are inserted into respective narrowing cavities 406 via corresponding apertures 408, causing articulation notch 402 to open and locking clip 320 to expand in gap 318. In certain embodiments, the one or more elongated elements 412 are screws and inserting the one or more elongated elements 412 into respective narrowing cavities 406 via corresponding apertures 408 includes twisting the screws (e.g., using a screwdriver) into the respective narrowing cavities 406, causing articulation notch 402 to open and locking clip 320 to expand. Engagement of tab 424 of locking clip in slot 324 (at step 610) and expansion of locking clip 320 in gap 318 (at step 612) inhibits removal of locking clip 320 from gap 318, thereby further securing panel 202*b* in position on support anchors 204*b* and 204*c*.

At step 614, method 600 ends.

Example method 600 has been described using panel 202*b* and support anchors 204*b* and 204*c*; however, method 600 may be used to install any suitable panels 202 using any suitable support anchors 204.

Additionally, some or all of method 600 may be repeated to install additional support anchors 204 and/or panels 202. For example, additional panels 202 may be mounted using the already-attached support anchors 204*b* and 204*c*, additional support anchors 204 may be positioned end-to-end with already-attached support anchors 204*b* and 204*c* to create longer rows of mounted panels 202, and/or additional support anchors 204 may be attached to substrate 206 above or below the already-attached support anchors 204*b* and 204*c* to create additional rows of mounted panels 202.

Figure 7:
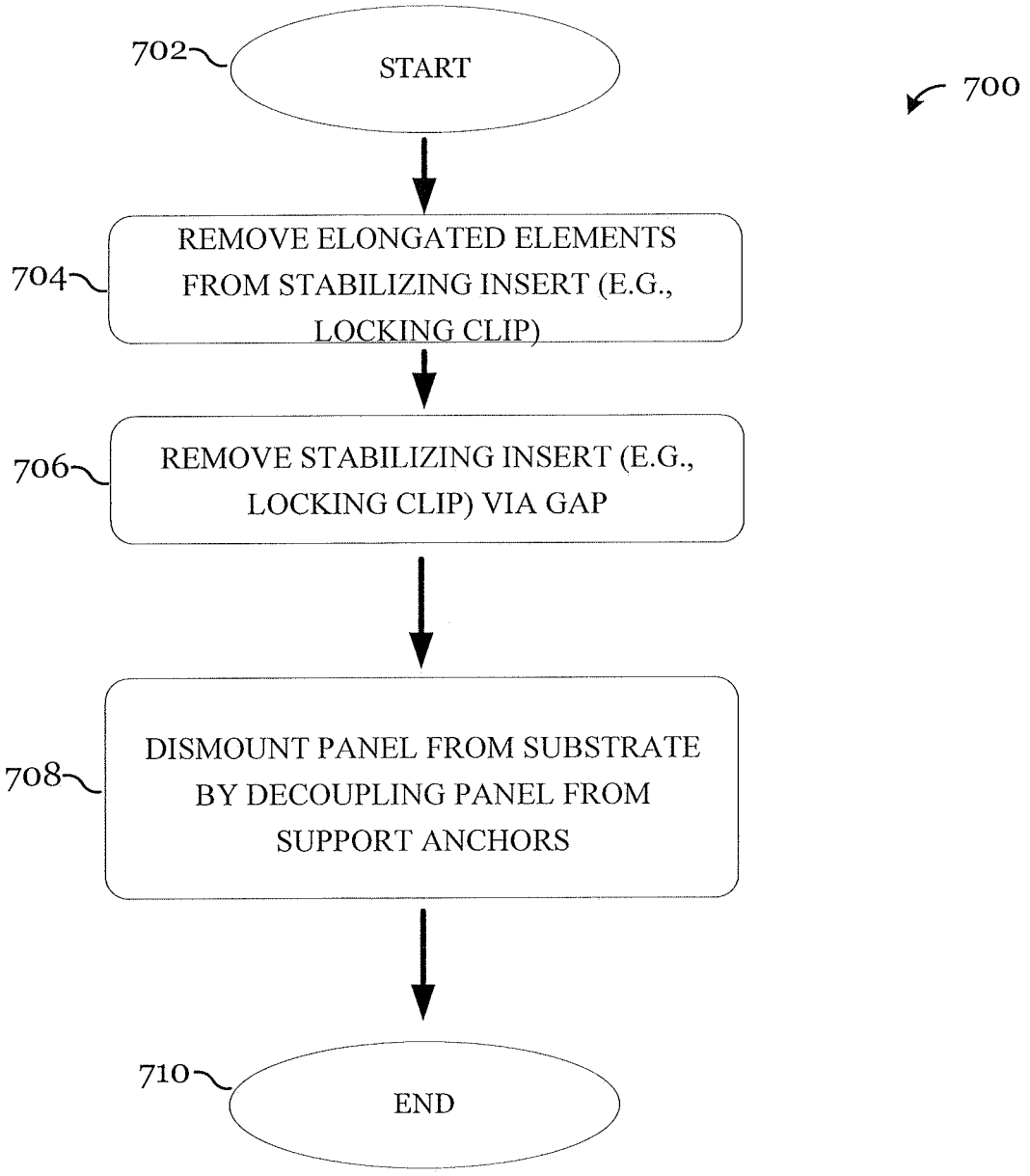
FIG. 7 illustrates an example method for removing a panel, according to certain embodiments of this disclosure.

FIG. 7 illustrates an example method 700 for removing a panel 202, according to certain embodiments of this disclosure. For purposes of this example, the panel being removed is panel 202*b*, which is being removed from support anchors 204*b* and 204*c*. The method begins at step 702.

At step 704, elongated elements 412 are removed from locking clip 320, which is in position and expanded in gap 318. Elongated elements 412 may be accessed through gap 318. In an example in which elongated elements 412 are screws, elongated elements 412 are unscrewed using a screwdriver of sufficient length to reach elongated elements 412 through gap 318. To the extent multiple locking clips 320 are used to secure panel 202*b*, the elongated elements 412 for all such locking clips 320 are removed.

At step 706, locking clip 320 is removed via gap 318. In certain embodiments, locking clip 320 is at least somewhat resilient such that if elongated elements 412 are removed, articulation notch 402 closes at least partially such that locking clip 320 may be slid back through gap 318 to remove locking clip 320. To the extent multiple locking clips 320 are used to secure panel 202*b*, each of the locking clips 320 is removed via gap 318. As described above, locking clip 320 may be removed in any suitable manner, including the above-described manners.

At step 708, with the one or more locking clips 320 removed, panel 202*b* may be dismounted from substrate 206 by decoupling panel 202*b* from support anchors 204*b* and 204*c*. In particular, end 214*b* of panel 202*b* may be decoupled from support anchor 204*b* by disengaging interlocking bracket 226*b* from prong 222*b* and end 212*b* of panel 202*b* may be decoupled from support anchor 204*c*.

As a first example technique for decoupling panel 202*b* from support anchors 204*b* and 204*c* (and essentially a reversal of the above-described first example technique for coupling panel 202*b* to support anchors 204*b* and 204*c*, as illustrated example of FIGS. 3A-3B), panel 202*b* may be lifted vertically such that tab 220*c* is partially removed from slot 224 at end 212*b* of panel 202*b* and interlocking bracket 226*b* disengages from prong 222*b*. For example, panel 202*b* may be lifted vertically at least a sufficient amount for protrusion 312 of interlocking bracket 226*b* to, in a subsequent act, clear the gap between prong 222*b* and projection 218*b* of support anchor 204*b* (e.g., the physical attributes of this gap and interlocking bracket 226*b* being configured to allow protrusion 312 of interlocking bracket 226*b* to clears this gap), or for complementary mating surfaces of prong 222*b* and interlocking bracket 226*b* (e.g., protrusion 312) to disengage.

Continuing with this first example technique for decoupling panel 202*b* from support anchors 204*b* and 204*c*, panel 202*b* then may be rotated away from substrate 206 until panel 202*b* may be lifted at an angle vertically and away from substrate 206 such that tab 220*c* is fully removed from slot 224 at end 212*b* of panel 202*b* to dismount panel 202*b*. For example, panel 202*b* first may be rotated away from substrate 206 until protrusion 312 of interlocking bracket 226*b* clears the gap between prong 222*b* and projection 218*b* of support anchor 204*b* (e.g., the physical attributes of this gap and interlocking bracket 226*b* being configured to allow protrusion 312 of interlocking bracket 226*b* to clears this gap) and until panel 202*b* is able to be lifted at an angle vertically and away from substrate 206 to fully remove tab 220*c* from slot 224 at end 212*b* of panel 202*b*. Panel 202*b* then may be lifted at an angle vertically and away from substrate 206 such that tab 220*c* is fully removed from slot 224 at end 212*b* of panel 202*b* to dismount panel 202*b*.

As a second example technique for decoupling panel 202*b* from support anchors 204*b* and 204*c* (and essentially a reversal of the above-described second example technique for coupling panel 202*b* to support anchors 204*b* and 204*c*), panel 202*b* may be lifted vertically such that tab 220*c* is removed from slot 224 at end 212*b* of panel 202*b* and interlocking bracket 226*b* disengages from prong 222*b*, and panel 202*b* may be pulled in a direction generally perpendicular to substrate 206 to dismount panel 202*b*.

In either example decoupling process, in certain embodiments, panel 202*b* is able to be decoupled from support anchors 204*b* and 204*c* without breaking or otherwise damaging panel 202*b*.

At step 710, method 700 ends.

Although in describing or illustrating certain processes and methods, this disclosure describes or illustrates particular steps as occurring in a particular order, this disclosure contemplates the steps being performed in any suitable order. Moreover, this disclosure contemplates any suitable steps being repeated one or more times in any suitable order. Although this disclosure describes or illustrates particular steps as occurring in sequence, this disclosure contemplates any suitable steps occurring at substantially the same time, where appropriate.

Figure 8:
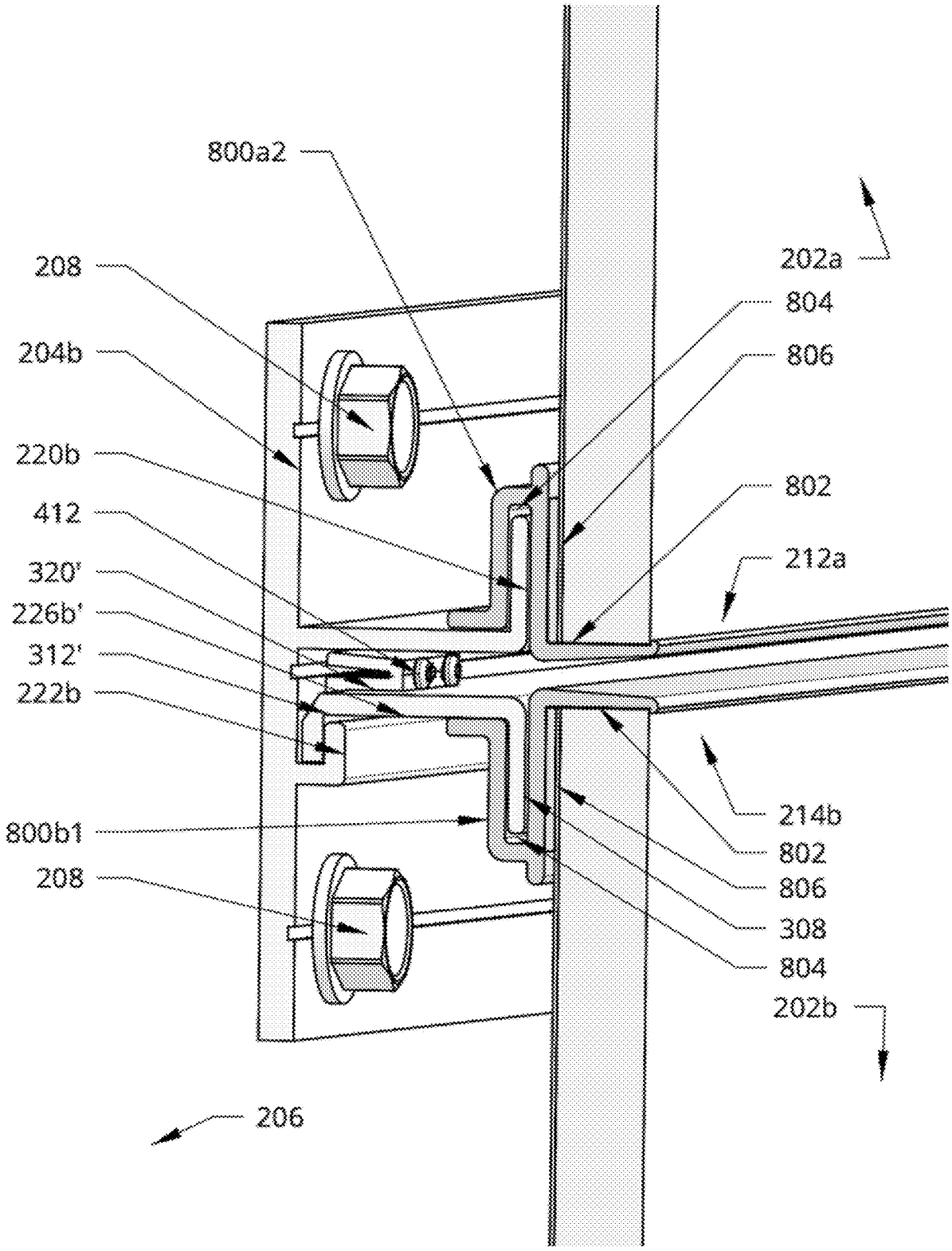
FIG. 8 illustrates an example panel installation system in which panels are coupled to support anchors using mounting clips, according to certain embodiments of this disclosure.

FIG. 8 illustrates an example panel installation system in which panels are coupled to support anchors using mounting clips, according to certain embodiments of this disclosure. In particular, FIG. 8 illustrates a first panel 202 (e.g., panel 202*a*) having an end 212*a* (e.g., a lower end) coupled to a tab 220 (e.g., tab 220*b*) of a support anchor 204 (e.g., support anchor 204*b*) and a second panel 202 (e.g., panel 202*b*) having an end 214*b* (e.g., an upper end) coupled to support anchor 204*b* via engagement of interlocking bracket 226*b*' with prong 222*b* of support anchor 204*b*.

In contrast to the example illustrated in FIGS. 3A-3D, in the example illustrated in FIG. 8, mounting clips 800 are used to couple panels 202*a* and 202*b* to support anchor 204. Each mounting clip 800 includes oppositely facing channels 802 and 804, a first channel 802 for engaging with a panel 202 and a second channel 804 for facilitating engagement with a support anchor 204. An adhesive 806 may be applied between a mounting clip 800 and a panel 202 to secure the mounting clip 800 to the panel 202.

In particular, a mounting clip 800*a*2 is coupled to end 212*a* of panel 202*a* in a first channel 802 of mounting clip 800*a*2, and tab 220*b* of support anchor 204*b* is inserted in a second channel 804 of mounting clip 800*a*2 for coupling panel 202*a* to support anchor 204*b*. Adhesive 806 has been applied between mounting clip 800*a*2 and panel 202*a*. In this example, another mounting clip 800*a*1 (not shown for panel 202*a*) may be attached to end 214*a* of panel 202*a* and used to facilitate engagement of panel 202*a* with another support anchor 204 (e.g., support anchor 204*a*). Coupling of panel 202*b* to support anchor 204*b*, as described below, illustrates an example of how such a mounting clip 800*a*1 may be implemented and used to couple panel 202*a* to support anchor 204*a*.

A mounting clip 800*b*1 is coupled to end 214*b* of panel 202*b* in a first channel 802 of mounting clip 800*b*1, and leg 308 of interlocking bracket 226*b*' is inserted in a second channel 804 of mounting clip 800*b*1 to facilitate coupling panel 202*b* to support anchor 204*b*. In this example, another mounting clip 800*b*2 (not shown for panel 202*b*) may be attached to end 212*b* of panel 202*b* and used to facilitate engagement of panel 202*b* with another support anchor 204 (e.g., support anchor 204*c*). Mounting clip 800*b*2 may be implemented in a similar manner to mounting clip 800*a*2, and may couple to support anchor 204*c* in a similar manner to how mounting clip 800*a*2 couples to support anchor 204*b*.

In this example, a stabilizing insert is inserted between interlocking bracket 226*b*' and projection 218*b* of support anchor 204*b*, and this stabilizing insert is implemented as locking clip 320'. As illustrated, interlocking bracket 226*b*' has a different design that interlocking bracket 226*b*, including in relation to projection 312' of interlocking bracket 226*b*' and protrusion 312 of interlocking bracket 226*b*. Additionally, locking clip 320' has a different design than locking clip 320. Furthermore, the interface between locking clip 320' and interlocking bracket 226*b*' includes opposing sloped faces rather than the interface illustrated and described with respect to locking clip 320 and interlocking bracket 226*b*. These design variations are not due to the use of mounting clips 800, but instead demonstrate another example of how an interlocking bracket and a locking clip may be designed.

Although in the example of FIG. 8 a mounting clip 800 is described as being included at each end (ends 212 and 214) of a panel 202, this disclosure contemplates a mounting clip 800 being used at one end (e.g., either end 212 or 214) to couple a panel 202 to a support anchor 204, and the other end (e.g., the other of either end 212 or 214) of the panel 202 being coupled to another support anchor 204 in another manner (e.g., in a manner similar to that described above with reference to FIGS. 3A-3D).

Particular embodiments of this disclosure may provide one or more technical advantages. For example, certain embodiments provide an efficient system and installation method for installing panels to create a panel field. Certain embodiments allow panels of a panel field to be removed (and replaced, if appropriate) individually and without damaging the panel, reducing or eliminating the need to remove (and replace, if appropriate) numerous panels to remove/replace an isolated panel, which may improve efficiency in producing a desired panel field, reduce materials costs (e.g., the cost of multiple replacement panels), and reduce the cost of labor (e.g., for the time spent removing, and possibly replacing, multiple panels). Furthermore, because in certain embodiments panels may be removed without breaking or otherwise damaging the panels, replacing a panel may involve reinstalling the same panel that was removed, which over time may reduce costs associated with purchasing new replacement panels and may reduce or eliminate delays associated with obtaining new replacement panels.

Certain embodiments allow large and/or heavy panels to be installed. For example, due to the manner of engagement of an interlocking bracket with a prong of a support anchor and/or the use of a locking clip to further secure a panel that is mounted to support anchors attached to a substrate (e.g., a wall), mounted panels may be more securely mounted in position on support anchors attached to the substrate. Additionally or alternatively, one or more components used mount panels to a substrate (e.g., a wall) may be made of a variety of materials including high-grade stainless steel, which may increase a reliability of a coupling of panels to support anchors mounted to the substrate. For example, one or more of the support anchors, the interlocking bracket, or the locking clip may be made of such high-grade stainless steel. In certain embodiments, the panel installation system of this disclosure can support panels of exceeding nine square feet, three inches thick and weighing thousands of pounds.

Although described primarily in the context of a curtain wall system (with panels 202 being curtain wall members and substrate 206 being a wall), the system and techniques described in this disclosure may be used in any of a variety of applications, and with panels 202 having any suitable size, shape, and weight. That is, the system and techniques described in this disclosure can be scaled up to accommodate extremely large and/or heavy panels 202 (e.g., structural framing size or more) or scaled down to include small and/or light panels 202. As just one particular example, a very small version might be used to secure a thin panel 202 (e.g., 4 mm thick) or glass panels 202 for mounting on a system that can be made for very corrosive environments. As another particular example, a large version of the system might be used to secure panels 202 that form a sea wall or that form a blast fence on a military aircraft launch area. The size and materials of panels 202 and the components of system 200 may be customized to accommodate the applicable installation.

For example, aside from curtain walls generally, the system and techniques described in this disclosure may be used for any type of cover panel that may benefit from a process for removal for access or replacement, particularly if in a field that includes numerous panels 202. Some examples may include: precast concrete, photovoltaic panels, dimensional stone, screening, reflectors, radio communication equipment mounting, antenna covers such as cellular or microwave antenna covers, jet wash deflection assemblies, blast mitigation panels, marine docks and buildings, sea walls, interior trim panels, solar panel attachment, light panel attachment, and others.

As one example, panels 202 may include lighting or one or more displays. As a particular example, panels 202 may include area lighting, accent lighting, and/or displays. In the case of displays, a panel 202 that includes a display could be part of a field of panels 202 that collectively make up one large display.

The components of the system can be created from any structurally sound material such as aluminum, steel, stainless steel, carbon fiber, structural plastics and foams, fiberglass, magnesium, and titanium, as just a few examples. Some projects might require the system to be non-conductive both thermally and electrically, so materials that meet those needs may be selected. Another project might require extreme resistance to corrosion, such as a removable panel system on an aircraft carrier, so materials that meet those needs may be selected.

Although throughout this disclosure support anchors 204 have generally been described as being parallel to one another when mounted to substrate 206, support anchors 204 may be mounted in other suitable arrangements relative to one another. For example, support anchors 204 may be mounted in an arrangement relative to one another that is appropriate for mounting the panel 202 to be installed. As discussed above, panels 202 may have any suitable shape. In a particular installation, one or more panels 202 may be triangularly shaped, and the support anchors to which those triangularly-shaped panels 202 are to be mounted may be arranged relative to one another at an angle that substantially matches an angle of the triangularly-shaped panel 202.

Although this disclosure has been described with several embodiments, a myriad of changes, variations, alterations, transformations, and modifications may be suggested to one skilled in the art, and it is intended that this disclosure encompass such changes, variations, alterations, transformation, and modifications as they fall within the scope of the appended claims.

Use of directional terms such as horizontal, vertical, upward, downward, above, below, top, bottom, upper, lower, and the like are used for ease of description only. Although the figures and accompanying description may describe a system in accordance with certain embodiments of this disclosure that is oriented in a particular direction, this disclosure contemplates the components of the system being oriented in different directions than those described, according to particular needs.

What is claimed is:

1. A curtain wall system, comprising:

a first support anchor that is elongated and comprises a base for attaching the first support anchor to a wall, a projection extending outwardly from the base of the first support anchor, and a tab extending upwardly from the projection of the first support anchor;

a second support anchor that is elongated and comprises a base for attaching the second support anchor to the wall spaced apart from the first support anchor, a projection extending outwardly from the base of the second support anchor, and a prong extending from the base of the second support anchor, wherein the second support anchor is configured to be positioned vertically above the first support anchor when attached to the wall, wherein the prong comprises a channel configured to be vertically upward-facing when the second support anchor is attached to the wall;

a curtain wall member adapted to be mounted to the wall via the first support anchor and the second support anchor such that a first end of the curtain wall member is coupled to the first support anchor and a second end of the curtain wall member is coupled to the second support anchor, wherein the first support anchor comprises the base, the projection extending outwardly from the base, and the tab extending upwardly from the projection prior to the curtain wall member being mounted to the wall via the first support anchor and the second support anchor;

an interlocking bracket configured to couple to the second end of the curtain wall member and to engage with the vertically upward-facing channel of the prong of the second support anchor for coupling the second end of the curtain wall member to the second support anchor, the second end of the curtain wall member being vertically above the first end of the curtain wall member when the curtain wall member is mounted to the wall via the first support anchor and the second support anchor; and a locking clip configured to be positioned in a gap between the interlocking bracket and the projection of the second support anchor.

2. A panel installation system, comprising:

a first support anchor that is elongated and comprises a base for attaching the first support anchor to a substrate, a projection extending outwardly from the base of the first support anchor, and a tab extending upwardly from the projection of the first support anchor;

a second support anchor that is elongated and comprises a base for attaching the second support anchor to the substrate spaced apart from the first support anchor, a projection extending outwardly from the base of the second support anchor, and a prong extending from the base of the second support anchor;

a first panel adapted to be mounted to the substrate via the first support anchor and the second support anchor such that a first end of the first panel is coupled to the first support anchor and a second end of the first panel is coupled to the second support anchor;

a first interlocking bracket comprising a first leg, a second leg, and a protrusion at an end of the second leg, wherein the first interlocking bracket is configured to couple to the second end of the first panel and to engage with the prong of the second support anchor for coupling the second end of the first panel to the second support anchor; and a first locking clip comprising a body and a tab extending from the body, wherein the first locking clip is configured to be positioned in a gap between the first interlocking bracket and the projection of the second support anchor, wherein the first locking clip is configured to expand in the gap between the first interlocking bracket and the projection of the second support anchor;

wherein:

the second leg of the first interlocking bracket and the protrusion at the end of the second leg define a slot, the slot adapted to receive the tab of the first locking clip; and the first locking clip is configured to be inserted in the gap until the tab of the first locking clip is received by the slot, expansion of the first locking clip in the gap between the first interlocking bracket and the projection of the second support anchor inhibiting removal of the first locking clip from the gap.

3. The panel installation system of claim 2, wherein:

the first panel comprises a slot that runs along an edge surface at the first end of the first panel; and the slot that runs along the edge surface at the first end of the first panel is configured to receive the tab of the first support anchor to couple the first end of the first panel to the first support anchor.

4. The panel installation system of claim 2, wherein:

the first panel comprises a slot that runs along an edge surface at the second end of the first panel; and the slot that runs along the edge surface at the second end of the first panel is configured to receive the first leg of the first interlocking bracket to couple the first interlocking bracket to the second end of the first panel.

5. The panel installation system of claim 4, wherein:

the prong extending from the base of the second support anchor forms a channel; and the channel is adapted to receive the protrusion at the end of the second leg of the first interlocking bracket to engage the first interlocking bracket with the prong.

6. The panel installation system of claim 5, wherein the body of the first locking clip comprises:

an articulation notch running a length of the body, the articulation notch open along a first edge surface of the body; and a narrowing cavity within the body, the narrowing cavity having an aperture in a second edge surface of the body opposite the first edge surface of the body, the narrowing cavity being adapted to receive an elongated element via the aperture, causing the articulation notch to open and the first locking clip to expand in the gap between the first interlocking bracket and the projection of the second support anchor.

7. The panel installation system of claim 2, wherein:

the first locking clip comprises an insertion tool opening and associated insertion tool cavity; and the insertion tool cavity is configured to receive a portion of an insertion tool via the insertion tool opening to position the first locking clip in the gap between the first interlocking bracket and the projection of the second support anchor, wherein the insertion tool is for inserting the first locking clip in the gap.

8. The panel installation system of claim 2, wherein:

the first locking clip is configured to be removed through the gap between the first interlocking bracket and the projection of the second support anchor; and to dismount the first panel from the substrate:

the first interlocking bracket is configured to disengage from the prong to decouple the second end of the first panel from the second support anchor; and the first end of the first panel is configured to be decoupled from the first support anchor.

9. The panel installation system of claim 2, wherein:

the first support anchor further comprises a prong extending from the base of the first support anchor; and the panel installation system further comprises:

a third support anchor that is elongated and comprises a base for attaching the third support anchor to the substrate spaced apart from the first support anchor, the first support anchor being between the second support anchor and the third support anchor, the third support anchor further comprising a projection extending outwardly from the base of the third support anchor and a tab extending upwardly from the projection of the third support anchor;

a second panel adapted to be mounted to the substrate via the first support anchor and the third support anchor such that a first end of the second panel is coupled to the third support anchor and a second end of the second panel is coupled to the second support anchor;

a second interlocking bracket configured to couple to the second end of the second panel and to engage with the prong of the first support anchor for coupling the second end of the second panel to the first support anchor; and a second locking clip configured to be positioned in a gap between the second interlocking bracket and the projection of the first support anchor.

10. The panel installation system of claim 2, wherein the first panel is made of stone, concrete, or brick.

11. The panel installation system of claim 2, wherein the first support anchor, the second support anchor, the first interlocking bracket, and the first locking clip are each made from stainless steel, titanium, aluminum, structural plastic, silicone, or carbon fiber.

12. A panel installation method, comprising:

attaching a first support anchor to a substrate, the first support anchor being elongated and comprising a base for attaching the first support anchor to the substrate, a projection extending outwardly from the base of the first support anchor, and a tab extending upwardly from the projection of the first support anchor;

attaching a second support anchor to the substrate spaced apart from the first support anchor, the second support anchor being elongated and comprising a base for attaching the second support anchor to the substrate, a projection extending outwardly from the base of the second support anchor, and a prong extending from the base of the second support anchor;

mounting, subsequent to attaching the first support anchor and the second support anchor to the substrate, a panel to the substrate via the first support anchor and the second support anchor, wherein mounting the panel comprises:

coupling a first end of the panel to the first support anchor;

coupling an interlocking bracket to a second end of the panel; and coupling, subsequent to coupling the interlocking bracket to the second end of the panel, the second end of the panel to the second support anchor by engaging the interlocking bracket with the prong of the second support anchor; and positioning a stabilizing insert in a gap between the interlocking bracket and the projection of the second support anchor.

13. The panel installation method of claim 12, wherein coupling the first end of the panel to the first support anchor comprises inserting the tab of the first support anchor into a slot that runs along an edge surface at the first end of the panel.

14. The panel installation method of claim 12, wherein:

the interlocking bracket comprises a first leg, a second leg, and a protrusion at an end of the second leg; and coupling the interlocking bracket to the second end of the panel comprises inserting the first leg into a slot that runs along an edge surface at the second end of the panel.

15. The panel installation method of claim 14, wherein engaging the interlocking bracket with the prong comprises seating the protrusion at the end of the second leg in a channel formed by the prong extending from the base of the second support anchor.

16. The panel installation method of claim 15, wherein:

the stabilizing insert is a locking clip;

the locking clip comprises a body, the body comprising:

an articulation notch running a length of the body, the articulation notch open along a first edge surface of the body; and a narrowing cavity within the body, the narrowing cavity having an aperture in a second edge surface of the body opposite the first edge surface of the body; and the method further comprises:

inserting the locking clip in the gap between the interlocking bracket and the projection of the second support anchor; and inserting an elongated element into the narrowing cavity via the aperture, causing the articulation notch to open and the locking clip to expand in the gap between the interlocking bracket and the projection of the second support anchor.

17. The panel installation method of claim 16, wherein:

the locking clip further comprises a tab extending from the body;

the second leg of the interlocking bracket and the protrusion at the end of the second leg define an interlocking bracket slot, the interlocking bracket slot adapted to receive the tab of the locking clip; and inserting the locking clip in the gap comprises sliding the locking clip until the tab of the locking clip is received by the interlocking bracket slot, expansion of the locking clip in the gap between the interlocking bracket and the projection of the second support anchor inhibiting removal of the locking clip from the gap.

18. The panel installation method of claim 16, wherein:

the elongated element is a screw; and inserting the elongated element into the narrowing cavity via the aperture comprises twisting the screw into the narrowing cavity, causing the articulation notch to open and the locking clip to expand.

19. The panel installation method of claim 12, wherein:

the stabilizing insert is a locking clip;

the locking clip comprises an insertion tool opening and associated insertion tool cavity; and positioning the locking clip in the gap between the interlocking bracket and the projection of the second support anchor comprises inserting a portion of an insertion tool in the insertion tool cavity via the insertion tool opening and sliding the locking clip in the gap by pushing on the insertion tool.

20. The panel installation method of claim 12, further comprising:

removing the stabilizing insert;

dismounting the panel from the substrate, wherein dismounting the panel comprises:

decoupling the second end of the panel from the second support anchor by disengaging the interlocking bracket from the prong; and decoupling the first end of the panel from the first support anchor.

21. The panel installation method of claim 12, wherein:
the substrate comprises a wall of a structure; and
the panel comprises a curtain wall member.

* * * * *